US011723832B2

(12) United States Patent
Radbourne

(10) Patent No.: US 11,723,832 B2
(45) Date of Patent: Aug. 15, 2023

(54) RESPIRATION-ASSISTANCE SYSTEMS, DEVICES, OR METHODS

(71) Applicant: Mark Bruce Radbourne, Anoka, MN (US)

(72) Inventor: Mark Bruce Radbourne, Anoka, MN (US)

( * ) Notice: Subject to any disclaimer, the term of this patent is extended or adjusted under 35 U.S.C. 154(b) by 1025 days.

(21) Appl. No.: 16/394,262

(22) Filed: Apr. 25, 2019

(65) Prior Publication Data

US 2020/0121551 A1 Apr. 23, 2020

Related U.S. Application Data

(63) Continuation of application No. 13/996,289, filed as application No. PCT/US2011/066777 on Dec. 22, 2011, now abandoned.

(Continued)

(51) Int. Cl.
*A61H 31/00* (2006.01)
*A61H 31/02* (2006.01)

(Continued)

(52) U.S. Cl.
CPC ..... *A61H 31/00* (2013.01); *A61H 31/006* (2013.01); *A61H 31/02* (2013.01); *A61G 5/10* (2013.01);

(Continued)

(58) Field of Classification Search
CPC ..... A61H 31/00; A61H 31/006; A61H 31/02; A61H 31/008; A61H 39/002; A61H 2201/0142; A61H 2201/0149; A61H 2201/10; A61H 2201/1215; A61H 2201/123; A61H 2201/1246;

(Continued)

(56) References Cited

U.S. PATENT DOCUMENTS 443,204 A 12/1890 Davis
651,962 A 6/1900 Boghean (Continued)

FOREIGN PATENT DOCUMENTS

CN 2673364 Y 1/2005
CN 1909867 A 2/2007

(Continued)

OTHER PUBLICATIONS

"U.S. Appl. No. 13/996,289, Advisory Action dated Oct. 10, 2017", 2 pgs.

(Continued)

*Primary Examiner* — Quang D Thanh
(74) *Attorney, Agent, or Firm* — Schwegman Lundberg & Woessner, P.A.

(57) ABSTRACT

A respiration-assistance apparatus or method can include or use a lifting element such as to cyclically push, pull, or lift, toward a superior direction of the subject, at least one subject region during an inhalation portion of a respiration cycle of the subject. A cyclical member can couple the lifting element to a fixed reference. Abdominal or ribcage compression can be provided. A multi-action or other cam can be used, such as together with a reciprocating element. Examples can be configured for use with a wheelchair, a bed, a vacuum or suction affixation element, a wearable garment, etc.

20 Claims, 15 Drawing Sheets

Related U.S. Application Data

(60) Provisional application No. 61/535,224, filed on Sep. 15, 2011, provisional application No. 61/441,191, filed on Feb. 9, 2011, provisional application No. 61/426,897, filed on Dec. 23, 2010.

(51) Int. Cl.
*A61H 39/00* (2006.01)
*A61G 5/10* (2006.01)

(52) U.S. Cl.
CPC ..... *A61H 31/008* (2013.01); *A61H 39/002* (2013.01); *A61H 2201/0142* (2013.01); *A61H 2201/0149* (2013.01); *A61H 2201/10* (2013.01); *A61H 2201/123* (2013.01); *A61H 2201/1215* (2013.01); *A61H 2201/1246* (2013.01); *A61H 2201/149* (2013.01); *A61H 2201/1418* (2013.01); *A61H 2201/165* (2013.01); *A61H 2201/1609* (2013.01); *A61H 2201/1616* (2013.01); *A61H 2201/1628* (2013.01); *A61H 2201/1652* (2013.01); *A61H 2201/1664* (2013.01); *A61H 2201/1671* (2013.01); *A61H 2201/501* (2013.01); *A61H 2201/5007* (2013.01); *A61H 2201/5035* (2013.01); *A61H 2201/5097* (2013.01); *A61H 2205/083* (2013.01); *A61H 2205/084* (2013.01); *A61H 2230/06* (2013.01); *A61H 2230/25* (2013.01); *A61H 2230/50* (2013.01)

(58) Field of Classification Search
CPC ..... A61H 2201/1418; A61H 2201/149; A61H 2201/1609; A61H 2201/1616; A61H 2201/1628; A61H 2201/165; A61H 2201/1652; A61H 2201/1664; A61H 2201/1671; A61H 2201/5007; A61H 2201/501; A61H 2201/5035; A61H 2201/5097; A61H 2205/083; A61H 2205/084; A61H 2230/06; A61H 2230/25; A61H 2230/50; A61G 5/10
See application file for complete search history.

(56) References Cited

U.S. PATENT DOCUMENTS

| | | | | |
|---|---|---|---|---|
| 2,071,215 | A | 2/1937 | Peterson | |
| 2,169,784 | A | 8/1939 | Andersen | |
| 2,241,444 | A | 5/1941 | Bower | |
| 2,263,844 | A | 11/1941 | Hammond | |
| 2,436,853 | A | 3/1948 | Coleman | |
| 2,486,667 | A | 11/1949 | Meister | |
| 2,490,395 | A | 12/1949 | Wilm | |
| 2,579,474 | A | 12/1951 | Crawford | |
| 2,582,210 | A | 1/1952 | Stanton | |
| 2,754,817 | A | 7/1956 | Nemeth | |
| 3,120,228 | A | 2/1964 | Huxley, III | |
| 3,368,550 | A * | 2/1968 | Glascock | A61H 31/02 601/44 |
| 3,481,327 | A | 12/1969 | Drennen | |
| 3,777,744 | A | 12/1973 | Fryfogle et al. | |
| 4,004,579 | A | 1/1977 | Dedo | |
| 4,257,407 | A * | 3/1981 | Macchi | A61H 31/02 601/44 |
| 4,340,015 | A | 7/1982 | Gonzalez | |
| 4,397,306 | A | 8/1983 | Weisfeldt et al. | |
| 4,424,806 | A | 1/1984 | Newman et al. | |
| 4,770,164 | A | 9/1988 | Lach et al. | |
| 4,770,165 | A | 9/1988 | Hayek | |
| 4,881,527 | A | 11/1989 | Lerman | |
| 4,915,095 | A | 4/1990 | Chun | |
| 4,951,655 | A | 8/1990 | MacMillian et al. | |
| 4,971,042 | A | 11/1990 | Lerman | |
| 5,056,505 | A | 10/1991 | Warwick et al. | |
| 5,076,259 | A | 12/1991 | Hayek | |
| 5,222,478 | A | 6/1993 | Scarberry et al. | |
| 5,257,619 | A | 11/1993 | Everete | |
| 5,332,287 | A | 7/1994 | Whitmyer | |
| 5,487,722 | A | 1/1996 | Weaver, II et al. | |
| 5,490,820 | A | 2/1996 | Schock et al. | |
| 5,573,498 | A | 11/1996 | Hayek | |
| 5,592,938 | A | 1/1997 | Scarberry et al. | |
| 5,630,789 | A | 5/1997 | Schock et al. | |
| 5,634,886 | A | 6/1997 | Bennett | |
| 5,739,637 | A | 4/1998 | Boettcher | |
| D399,000 | S | 9/1998 | Rothman et al. | |
| 5,820,572 | A | 10/1998 | Palmer | |
| 5,827,893 | A | 10/1998 | Lurie et al. | |
| 6,142,962 | A | 11/2000 | Mollenauer et al. | |
| 6,234,984 | B1 | 5/2001 | Kelly et al. | |
| 6,325,771 | B1 | 12/2001 | Kelly et al. | |
| 6,345,618 | B1 | 2/2002 | Hayek | |
| 6,379,311 | B1 | 4/2002 | Gaumond et al. | |
| 6,447,465 | B1 | 9/2002 | Sherman et al. | |
| 6,648,841 | B1 | 11/2003 | Sessler | |
| 6,726,639 | B2 | 4/2004 | Bassuk et al. | |
| 7,435,233 | B2 | 10/2008 | Baldauf et al. | |
| 7,509,157 | B2 | 3/2009 | Hayek | |
| 7,744,547 | B2 | 6/2010 | Jiang et al. | |
| 2004/0176709 | A1 * | 9/2004 | Van Brunt | A61H 31/00 601/44 |
| 2005/0165334 | A1 | 7/2005 | Lurie | |
| 2007/0191881 | A1 | 8/2007 | Amisar et al. | |
| 2008/0149099 | A1 | 6/2008 | Doyle | |
| 2008/0167586 | A1 | 7/2008 | Baldauf et al. | |
| 2008/0275356 | A1 | 11/2008 | Stasz et al. | |
| 2008/0300518 | A1 | 12/2008 | Bowes | |
| 2009/0020128 | A1 | 1/2009 | Metzger et al. | |
| 2009/0099472 | A1 | 4/2009 | Remmert et al. | |
| 2009/0171256 | A1 | 7/2009 | Fiorina | |
| 2009/0171259 | A1 | 7/2009 | Soerensen et al. | |
| 2009/0234256 | A1 | 9/2009 | Helgeson et al. | |
| 2010/0041980 | A1 | 2/2010 | Hayek | |
| 2010/0326442 | A1 | 12/2010 | Hamilton et al. | |
| 2012/0016280 | A1 | 1/2012 | Aliverti et al. | |
| 2012/0310127 | A1 | 12/2012 | Zacharopoulos | |
| 2014/0024979 | A1 | 1/2014 | Radbourne | |

FOREIGN PATENT DOCUMENTS

| | | | |
|---|---|---|---|
| CN | 203043449 | U | 7/2013 |
| CN | 103826593 | A | 5/2014 |
| GB | 1205200 | A | 9/1970 |
| WO | WO-2012088390 | A1 | 6/2012 |

OTHER PUBLICATIONS

"U.S. Appl. No. 13/996,289, Decision on Pre-Appeal Brief Request dated Apr. 8, 2019", 2 pgs.
"U.S. Appl. No. 13/996,289, Final Office Action dated Jul. 31, 2017", 18 pgs.
"U.S. Appl. No. 13/996,289, Final Office Action dated Oct. 23, 2018", 22 pgs.
"U.S. Appl. No. 13/996,289, Non Final Office Action dated Jan. 22, 2016", 15 pgs.
"U.S. Appl. No. 13/996,289, Non Final Office Action dated Dec. 28, 2017", 22 pgs.
"U.S. Appl. No. 13/996,289, Notice of Non-Compliant Amendment dated Jun. 22, 2016", 3 pgs.
"U.S. Appl. No. 13/996,289, Pre Appeal Brief filed Feb. 25, 2019", 4 pgs.
"U.S. Appl. No. 13/996,289, Preliminary Amendment filed Jun. 20, 2013", 7 pgs.
"U.S. Appl. No. 13/996,289, Response filed Feb. 1, 2017 to Notice of Non-Compliant Amendment dated Jun. 22, 2016", 12 pgs.
"U.S. Appl. No. 13/996,289, Response filed Jun. 15, 2016 to Non Final Office Action dated Jan. 22, 2016", 15 pgs.
"U.S. Appl. No. 13/996,289, Response filed Jun. 27, 2018 to Non Final Office Action dated Dec. 28, 2017", 13 pgs.

(56) References Cited

OTHER PUBLICATIONS

"U.S. Appl. No. 13/996,289, Response filed Oct. 2, 2017 to Final Office Action dated Jul. 31, 2017", 12 pgs.
"Chinese Application Serial No. 201180068371.8, Office Action dated Jan. 23, 2015", 15 pgs.
"International Application Serial No. PCT/US2011/066777, International Preliminary Report on Patentability dated Jul. 4, 2013", 9 pgs.
"International Application Serial No. PCT/US2011/066777, Search Report dated Apr. 23, 2012", 2 pgs.
"International Application Serial No. PCT/US2011/066777, Written Opinion dated Apr. 23, 2012", 7 pgs.
Bach, J R, et al., "Intermittent abdominal pressure ventilator in a regimen of noninvasive ventilatory support", CHEST Journal, 2(3), (Mar. 1991), 630-636.
Bach, J R, et al., "Management alternatives for post-polio respiratory insufficiency. Assisted ventilation by nasal or oral-nasal interface.", Am J Phys Med Rehabil, 68(6), Abstract Only, (Dec. 1989), 264-71.
Dettenmeier, Patricia A, et al., "Chronic Hypoventilation Syndrome: Treatment with Non-invasive Mechanical Ventilation", AACN Clinical Issues Critical Care Nursing, vol. 2, Abstract Only, (Aug. 1991), 415-31.
Hill, Nicholas S, et al., "Clinical Applications of Body Ventilators.", CHEST Journal, 90 (6), (Dec. 1986), 897-905.
Miller, H J et al., "Pneumobelt use among high quadriplegic population.", Arch Phys Med Rehabil, 69(5), Abstract Only, (May 1988), 369-72.
Vázquez, Galeiras Rita, et al., "Respiratory Management in the Patient with Spinal Cord Injury", BioMed Research International, vol. 2013, (2013), 12 pgs.
Yang, G. F, et al., "Pneumobelt for sleep in the ventilator user: clinical experience.", Arch Phys Med Rehabil, 70(9), Abstract Only, (Sep. 1989), 707-11.

* cited by examiner

RESPIRATION-ASSISTANCE SYSTEMS, DEVICES, OR METHODS

CLAIM OF PRIORITY

This patent application is a continuation of U.S. patent application Ser. No. 13/996,289, filed Oct. 8, 2013, which is a U.S. National Stage Filing Under U.S.C. 371 of International Patent Application Serial No. PCT/US2011/066777, filed on Dec. 22, 2011 and published on Jun. 28, 2012 as WO 2012/088390 A1, which claims the benefit of priority, under 35 U.S.C. Section 119(e), to Radbourne U.S. Provisional Patent Application Ser. No. 61/426,897, entitled "Devices and Methods for Assisting Respiration," filed on Dec. 23, 2010; to Radbourne U.S. Provisional Patent Application Ser. No. 61/441,191, entitled "Devices and Methods for Assisting Respiration." Filed on Feb. 9, 2011; to Radbourne U.S. Provisional Patent Application Ser. No. 61/535,224, entitled "Respiration-Assistance Systems, Devices, and Methods," filed on Sep. 15, 2011, which are hereby incorporated by reference herein in their entirety.

BACKGROUND

Trauma, disease, infection, genetics, or other factors can diminish the human body's ability to breathe. It is difficult to mechanically mimic the human body's method of respiration. U.S. Pat. No. 4,004,579 discloses a device that includes compression straps that extend around the lower region of a wearer's rib cage. The compression straps are pulled to compress the lower region of the wearer's ribcage to facilitate expiration. U.S. Pat. No. 7,744,547 discloses a negative pressure ventilation system. The system comprises an artificial ribcage that is designed to mimic the patient's own chest wall. U.S. Pat. No. 5,222,478 discloses a closely form-fitting shell around a portion of a human body. The pressure in the shell varies from ambient pressure for therapeutic purposes.

Overview

This document describes, among other things, an improved mechanical respiration system that can assist a subject's inhalation, exhalation, or both. When respiratory muscles fatigue or become non-functioning, applying pressure and movement to the thoracic and abdominal regions of respiration and circulation can augment or replace the movement of the affected muscles and can benefit the subject.

Certain approaches can include various negative and positive pressure ventilators, however, the sequence of applied pressures applied by both types of ventilators can conflict with the human body's natural respiratory movement, which may produce various complications. The human body uses a series of muscle contractions to produce a sequence of changing intrathoracic and intraabdominal pressures to produce inspiration, expiration, and to assist circulation. Other organs such as the heart, stomach, liver, and kidneys, can also benefit from the natural physiological sequence of changing pressures.

In the natural physiology of the human body, the numerous thoracic joints are subject to continual movement, and any disorder that reduces their mobility can hamper respiration. In general, the ribs move around two axes. Movement at costovertebral joints 2 to 6 about a side-to-side axis results in raising and lowering the sternal end of the rib, which can be described as the "pump-handle" movement. The downward slope of the rib ensures that, in elevation, the sternum moves upward and forward, increasing the anteroposterior diameter of the thorax. Movement at costovertebral joints 7 to 10 about an anteroposterior axis results in raising and lowering the middle of the rib, which can be described as the "bucket-handle" movement. In elevation, this increases the transverse diameter of the thorax.

A movement of only a few millimeters of elevation can be sufficient to increase the volume of the thoracic cage by the usual volume of air that enters and leaves the lungs during quiet breathing. In deep breathing the changes are greater, sometimes as much as 10-12 millimeters. The descent of the diaphragm during contraction increases the height of the thoracic cavity and hence increases the volume of the thorax.

This document describes, among other things, an improved mechanical respiration system that can assist a subject's inhalation, exhalation, or both. The present techniques can include an element for inhalation, an element for exhalation, or both. The inhalation element can lift the sternum, head, neck, or shoulders, such as to cause the connecting muscles of inhalation to raise or lift the thorax or chest. Raising the chest can create a negative pressure within the lungs and can induce inhalation. The inhalation element can push in a superior direction with an abdominal pad. The rectus abdominus muscles can be relaxed enough, or non-responsive enough, for the abdominal pad to insert in, and under, one or more of, a costal cartilage, lower ribs, xiphoid, or sternum region, to provide a lifting movement. The lifting movement can elevate the thoracic region in a superior direction towards the skull, which can increase the volume between the thoracic cavity and the diaphragm. Increasing the volume between the thoracic cavity and the diaphragm can create a negative intrathoracic pressure, which can result in an increased tidal volume within the lungs, thereby reproducing inhalation with a mechanical device which moves the thorax.

The exhalation element can compress the abdomen or the ribcage, such as in order to move the abdominal contents, followed by the diaphragm, towards the lungs, or to move the thorax or lungs towards the diaphragm or abdominal contents. Moving the abdominal contents or the diaphragm towards the lungs, or moving the thorax or lungs towards the diaphragm or abdominal contents can create a decreased volume and an increased intrathoracic pressure, such as to force air out of the lungs. The inhalation and exhalation elements can be used individually or together. If the diaphragm is active, the diaphragmatic movement will be directed by the body, and the externally applied pressures will assist the internal pressures. If the diaphragm is inactive or paralyzed, the sequence of movements and externally applied pressures by the apparatus can dictate the directional movement of the diaphragm and the changing pressures on either side of the diaphragm.

Advantages or aspects that can optionally be provided by the present subject matter can include, by way of illustrative example, but not by way of limitation:

- sequentially providing rhythmic abdominal compressions, such as together with additional lower rib compressions;
- using a rotary screw or other cam to cyclically provide a reciprocation that can be used to provide abdominal compressions;
- providing a logical or other control that can pause or interrupt a respiration assistance cycle, such as to effect a different action (e.g., with a greater movement) during a portion of the respiration assistance cycle, such as together with then reverting back to and continuing the previously-interrupted portion of the respiration-assistance cycle;

providing a configuration of elements that can provide physical support, such as spinal support or cranial support, while providing respiratory or respiratory/circulatory assistance;

providing a respiratory assistance device that can also initiate cardiopulmonary resuscitation (CPR), such as with lowering of the thorax, such as in combination with providing abdominal compressions;

providing a respiratory assistance device that can also initiate and provide an improved method and automation of interposed abdominal compression cardiopulmonary resuscitation (IAC-CPR), such as with a cycle of lowering the thorax, which can be combined with abdominal and lower rib compressions or further thoracic compressions, which can be followed by a release and lifting of the thorax, such as for providing automated inspiration assistance using an automated device;

providing a respiratory assistance device that can use a portable tank or other source of compressed air as a power source and, optionally, then as a usable oxygen supply such as for supplementing breathing;

providing a respiration assistance device that can include a complete suit, which can include compartments that can provide a spinal support as well as assisting with the various movements providing respiration assistance;

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Wearable Example

Figure 1:
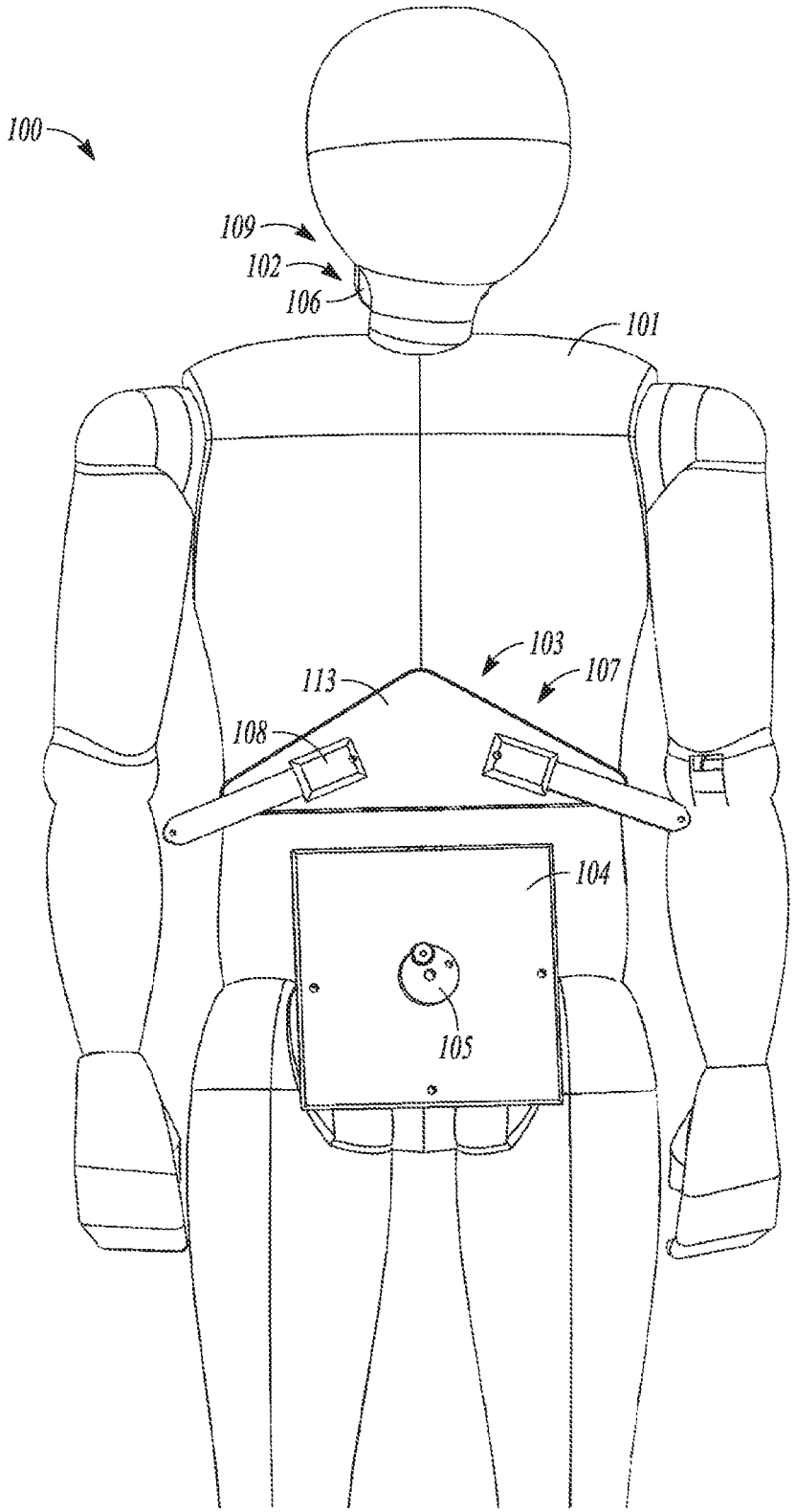
FIG. 1 is a front view of a respiration-assistance apparatus, according to an example.

FIG. 1 represents a front view of an example of portions of a respiration-assistance apparatus 100 and portions of an environment where it can be used. In an example, the apparatus 100 can include one or more of: a wearable vest-like garment 101, which can include an inhalation element 102, an exhalation element 103, a reference element 104, a cyclical member 105, mastoid process harness 106 or other harness, and a quick-release 108. The inhalation element 102 can include a lifting element 109. The exhalation element 103 can include a compression element 107.

In an example, the garment 101 can be configured to provide the ability to support an inhalation element 102, an exhalation element 103, or both. The inhalation element 102 can be configured to aid a subject's inhalation cycle. In an example, the inhalation cycle can be a portion of the subject's respiration cycle, such as where the subject draws air into the subject's lungs. The exhalation element 103 can be configured to aid a subject's exhalation cycle. In an example, the exhalation cycle can be a portion of the subject's respiration cycle, such as the portion of the respiration cycle where air exits the subject's lungs.

In an example, the respiration-assistance apparatus 100 can include a reference element 104. The reference element 104 can provide a fixed reference with respect to the subject. For example, the reference element 104 can be fixed in relation to the subject. This can provide a fixed reference, such that the inhalation element 102 or the exhalation element 103 can move with respect to the fixed reference provided by the reference element 104. There can be one or more reference elements 104 in a respiration-assistance apparatus 100.

A cyclical member 105 can be located at or near the reference element 104, and can be configured to control the inhalation cycle, the exhalation cycle, or both. The cyclical member 105 can be placed at such a fixed location, such as to connect or otherwise couple the cyclical member 105 to the reference element 104. The cyclical member 105 can be coupled to the lifting element 109, the compression element 107, or both.

The cyclical member 105 can move, such as to rotate or reciprocate. The cyclical member 105 can go through cycles, such as repeating a motion. The repeated motion can be a linear motion, such as back and forth. The repeated motion can be a rotational motion, such as motion around a point of rotation.

The cyclical member 105 can include or can be coupled to an actuator, such as a cam, a piston, a gear or a rotary screw. The cyclical member 105 can be driven by a motor, such as to help assist or control all or a portion of a respiration cycle.

When the cyclical member 105 is coupled to the lifting element 109, the cyclical member 105 can control the lifting element 109. The movement of the cyclical member 105 can apply a force on the coupling between the cyclical member 105 and the lifting element 109, such as to move the lifting element 109 in a generally superior or inferior direction. When the cyclical member 105 is coupled to the compression element 107, the cyclical member 105 can control the compression element 107. The movement of the cyclical member 105 can apply a force on the coupling between the cyclical member 105 and the compression element 107, such as to move the compression element 107 in a generally anterior or posterior direction. In an example, a single cyclical member 105 can control both the inhalation cycle and the exhalation cycle. In an example, different cyclical members 105 can be used to respectively control the inhalation cycle and the exhalation cycle. In an example, the cyclical member can include a multi-action cam.

Figure 2:
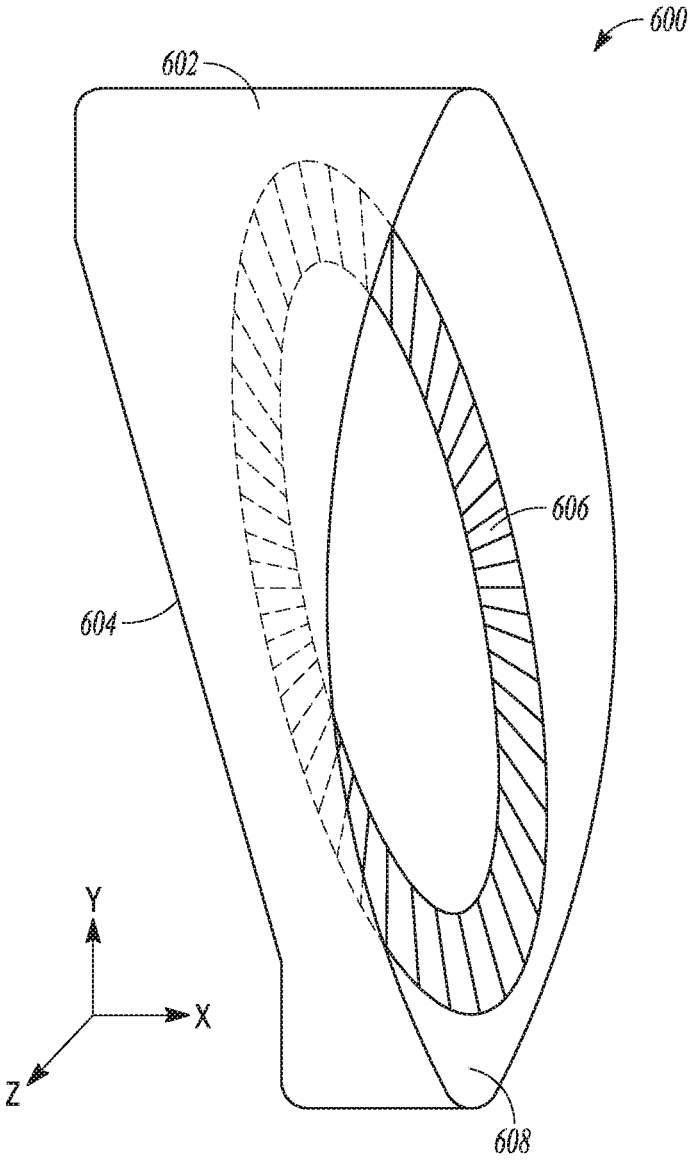
FIG. 2 is a perspective view of a tapered multi-action cam, according to an example.

In an example, a multi-action cam can be a tapered multi-action cam 600 (as shown in FIG. 2). The tapered multi-action cam 600 can be coupled to the reference element 104. The tapered multi-action cam 600 can be coupled to both the inhalation element 102 and the exhalation element 103, such as to control the inhalation cycle and the exhalation cycle. A single tapered multi-action cam 600 can control both the inhalation cycle and exhalation cycle. A tapered multi-action cam 600 can control the exhalation cycle and the inhalation cycle, even though the cycles may not have any similarities in regards to distance of travel, rate of travel, or timing. In an example, a tapered multi-action cam 600 can control the exhalation cycle with the shape of the tapered multi-action cam 600 on a certain surface and the tapered multi-action cam can control the inhalation cycle with the shape of the tapered multi-action cam 600 on a different surface. The surfaces can be on the same plane or on different planes.

FIG. 2 represents an example of a tapered multi-action cam 600. A tapered multi-action cam 600 can have more than one surface. Each surface of a tapered multi-action cam 600 can have a different shape from the other surfaces of the tapered multi-action cam 600. Each surface can have a follower 610, such as to control different elements. A single tapered multi-action cam 600 can be used instead of multiple cams.

Figure 3A:
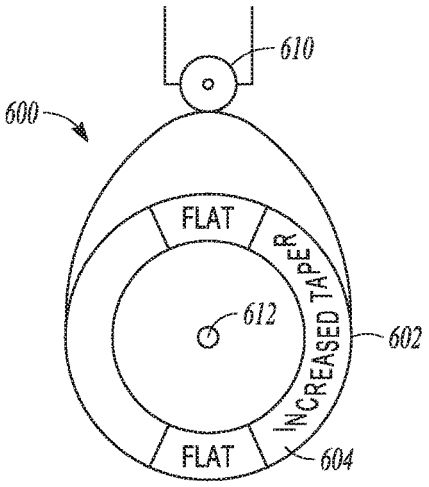
FIG. 3A is a front view of tapered multi-action cam, according to an example.

FIG. 3A represents an example of a tapered multi-action cam 600, with an outer surface 602, a top surface 604, a follower 610, and a rotational center 612. The follower 610 is on the outer surface 602. The movement of the follower 610 can be controlled by the outer surface 602.

Figure 3B:
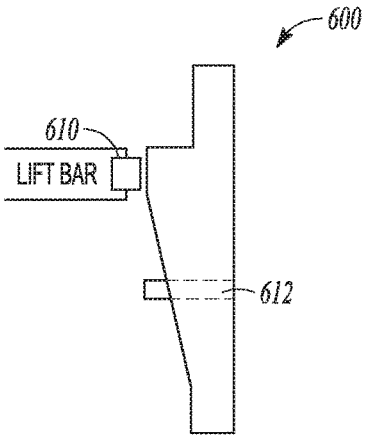
FIG. 3B is a side view of tapered multi-action cam, according to an example.

FIG. 3B shows a side view of a tapered multi-action cam 600 that has an outer surface 602, a top surface 604, a bottom plane 608, a follower 610, and a rotational center 612. The follower 610 is on the top surface 604. The movement of the follower 610 can, at least partially, be controlled by the top surface 604. The outer surface 602 can have a generally elliptical shape. The varying distance between the rotational center 612 of the tapered multi-action cam 600 and the outer surface 602 can affect the distance that a first follower 610 travels. The distance between the top surface 604 and the bottom plane 608 can have a varying distance. The varying distance between the bottom plane 608 and the top surface 604 can affect the distance that a second follower 610 travels. In an example, a tapered multi-action cam 600 can have an outer surface 602, a top surface 604, and a ring surface 606. A ring surface 606 can be recessed into the top surface 604 or bottom plane 608 of the tapered multi-action cam 600, extended from the top surface 604 or the bottom plane 608 of the tapered multi-action cam 600, or recessed in parts and extended in parts from the top surface 604 or the bottom plane 608 of the tapered multi-action cam 600. In an example, there can be more than one ring surface 606. A ring surface 606 can have a circular shape, such as to keep the follower 610, in one plane a constant distance from the rotational center 612 of the tapered multi-action cam 600. Each of the different ring surfaces 606 can have a unique varying distance between itself and the bottom plane 608 of the tapered multi-action cam 600. Each ring surface 606 can have a different follower 610. In an example, a tapered multi-action cam 600 can control multiple followers 610 in multiple planes. A follower 610 on the outer surface 602 could be positioned in order for its movement to be in the y-plane. A different follower 610 on the top surface 604 could be positioned in order for its movement to be in the z-plane. An additional follower 610 on a ring surface 606 could be positioned in order for its movement to be in the z-plane. Further, an additional follower 610 could be positioned on the outer surface 602 such that the movement of the follower 610 would be in the z-plane. A follower 610 could also be positioned on the outer surface 602 such that it has movement in both the z-plane and the y-plane. Additional placements of followers 610 are possible.

Figure 3C:
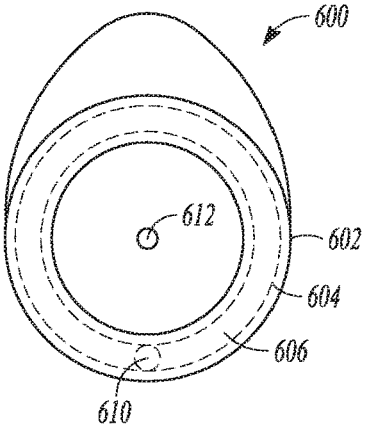
FIG. 3C is a front view of tapered multi-action cam, according to an example.
Figure 3D:
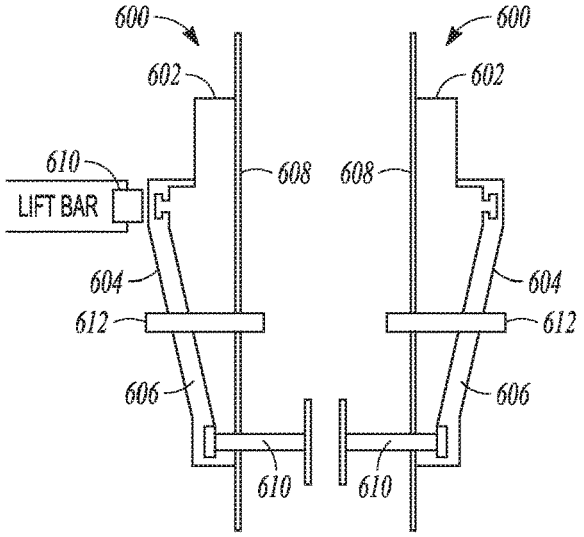
FIG. 3D is a side view of a cutaway tapered multi-action cam, according to an example.
Figure 3E:
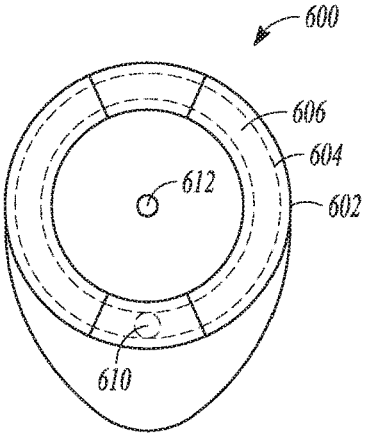
FIG. 3E is a front view of tapered multi-action cam, according to an example.

FIG. 3C and FIG. 3E show an example of a tapered multi-action cam 600 that has an outer surface 602, a top surface 604, a ring surface 606, and a rotational center 612.

Figure 3F:
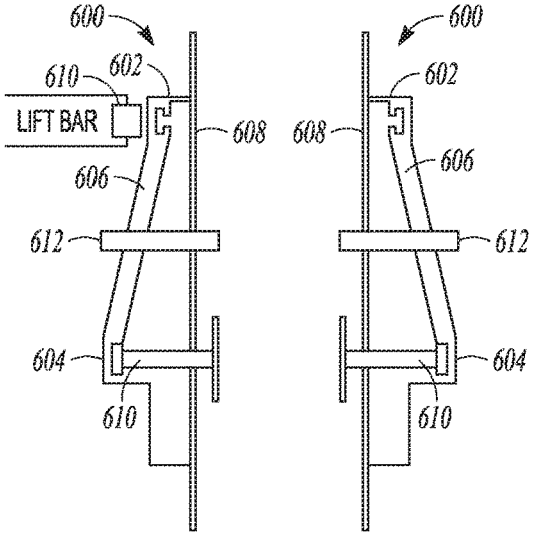
FIG. 3F is a side view of a cutaway tapered multi-action cam, according to an example.

FIG. 3D and FIG. 3F show a side view of the same tapered multi-action cam 600 as FIG. 3C and FIG. 3E.

FIG. 3D and FIG. 3F also show the bottom plane 608, as well as a second follower 610 on the top surface 604.

Figure 4A:
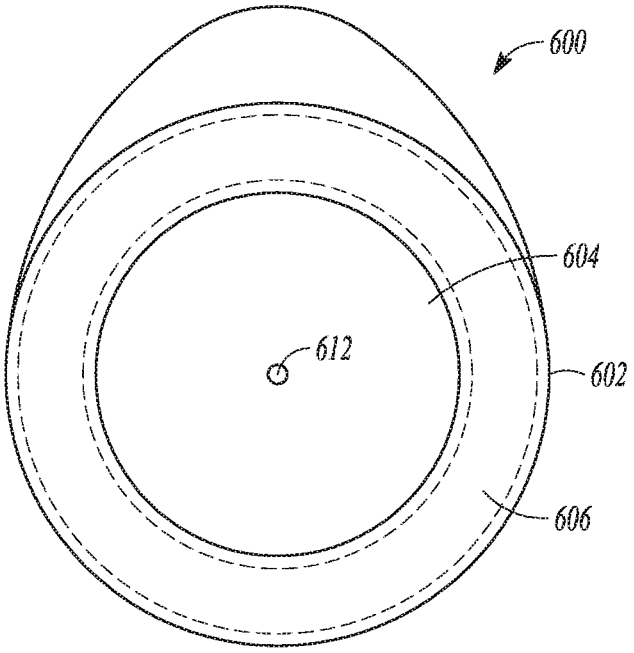
FIG. 4A is a front view of a cutaway tapered multi-action cam, according to an example.
Figure 4B:
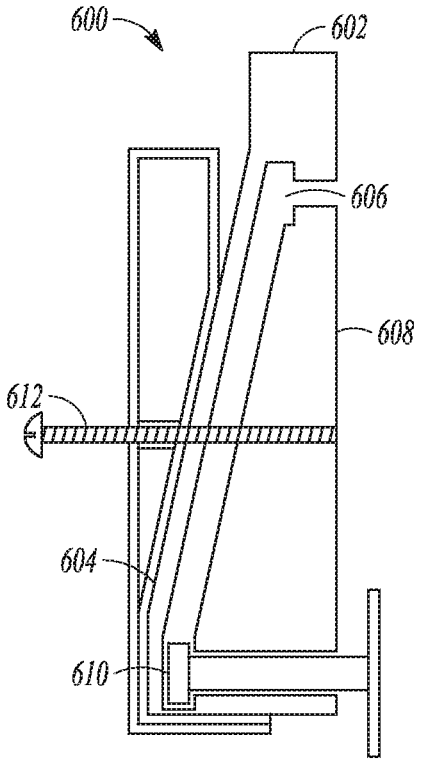
FIG. 4B is a side view of a cutaway tapered multi-action cam, according to an example.
Figure 4C:
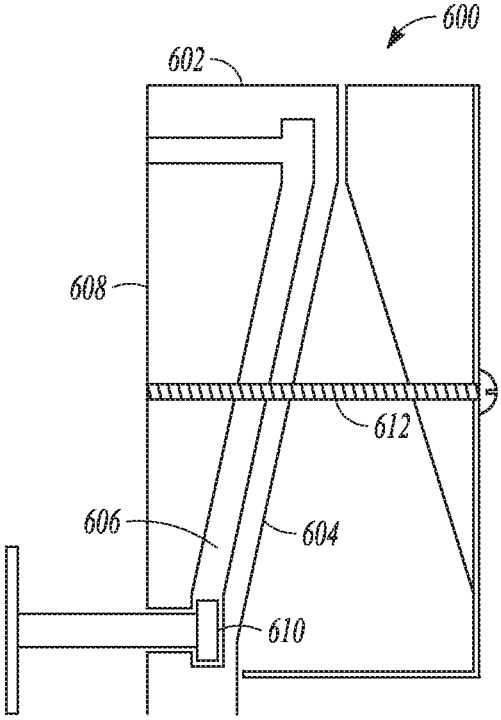
FIG. 4C is a side view of a cutaway tapered multi-action cam, according to an example.

FIG. 4A, FIG. 4B and FIG. 4C show a tapered multi-action cam 600. In an example, the tapered multi-action cam 600 can include an outer surface 602, a top surface 604, a ring surface 606, a bottom plane 608, a follower 610, and a rotational center 612.

Figure 5A:
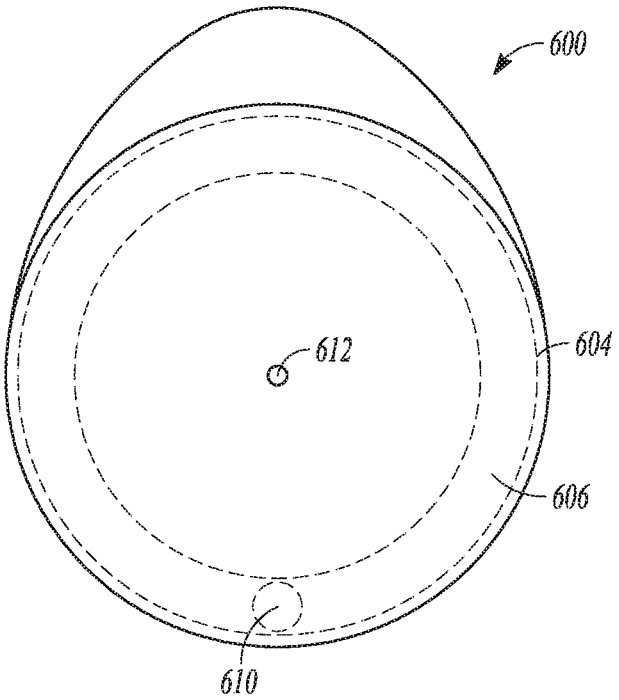
FIG. 5A is a front view of a cutaway tapered multi-action cam, according to an example.
Figure 5B:
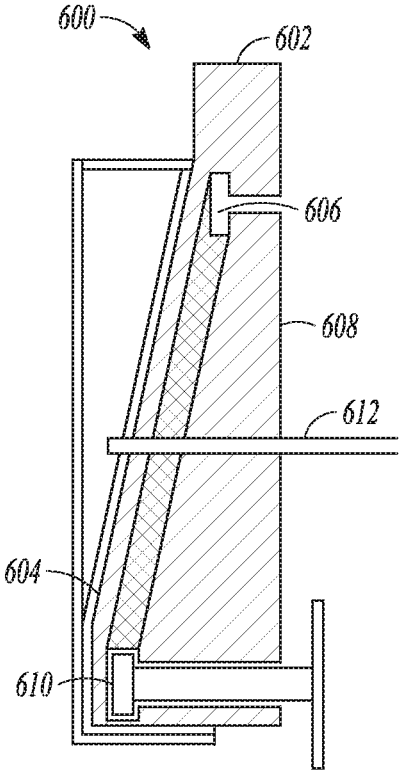
FIG. 5B is a side view of a cutaway tapered multi-action cam, according to an example.
Figure 5C:
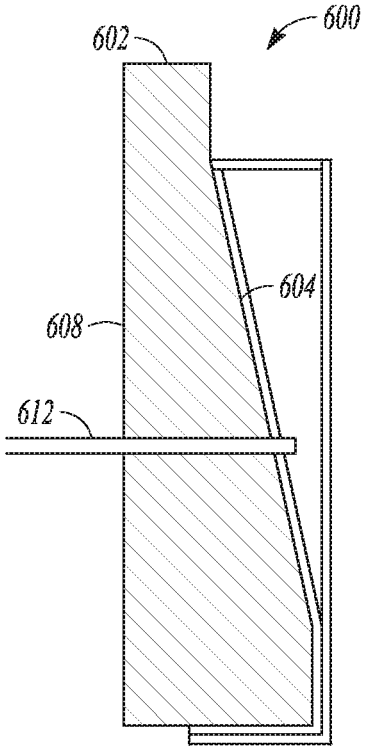
FIG. 5C is a side view of a cutaway tapered multi-action cam, according to an example.

FIG. 5A, FIG. 5B and FIG. 5C show a tapered multi-action cam 600. In an example, the tapered multi-action cam 600 can include an outer surface 602, a top surface 604, a ring surface 606, a bottom plane 608, a follower 610, and a rotational center 612.

The cyclical member 105 can be configured to be adjustable such as: (1) to control a distance of travel of the lifting element 109, a distance of travel of the compression element 107, or both; (2) to control a rate of travel of the lifting element 109, a rate of travel of the compression element 107, or both; or (3) an inhalation cycle (or other respiration cycle) timing of the lifting element 109, an exhalation cycle (or other respiration cycle) timing of the compression element 107, or both. The distance of travel in a cycle can affect the amount of compression that the compression element 107 applies to the subject, or the amount of lift that the lifting element 109 applies to the subject. A complete respiration cycle can include an inhalation part ("inhalation cycle") and an exhalation part ("exhalation cycle"). The respiration cycle can comprise a rest portion, such as a rest or pause between inhalation and exhalation cycles, or during an inhalation or exhalation cycle, or both between and during inhalation and exhalation cycles.

In an example, the respiration-assistance apparatus 100 can comprise a controller, such as to control the cyclical member 105. The controller can comprise a computer. In an example, the controller can detect when the subject requires a pause in his or her respiration cycles, such as to cough, sneeze, or regurgitate. The controller can detect the subject's need for a pause by sensors, such as by a button that the subject presses.

The cyclical member 105 can go through cycles, such as to reproduce the cycles of respiration. The cyclical member 105 can be cyclically adjusted in an adjustment cycle, such as to assist in all or part of one or more respiration cycles. In an example, the adjustment cycle of the cyclical member 105 can map 1:1 to a complete respiration cycle. In an example, the adjustment cycle of the cyclical member 105 can map 1:2 or 2:1 (or 1:3 or 3:1, etc.) to a complete respiration cycle. Other mappings between the adjustment cycle of the cyclical member 105 and the respiration cycle (or a portion thereof) are possible. The apparatus can also execute an incomplete cycle, such as if the apparatus was turned off in the middle of a respiration cycle.

Figure 7:
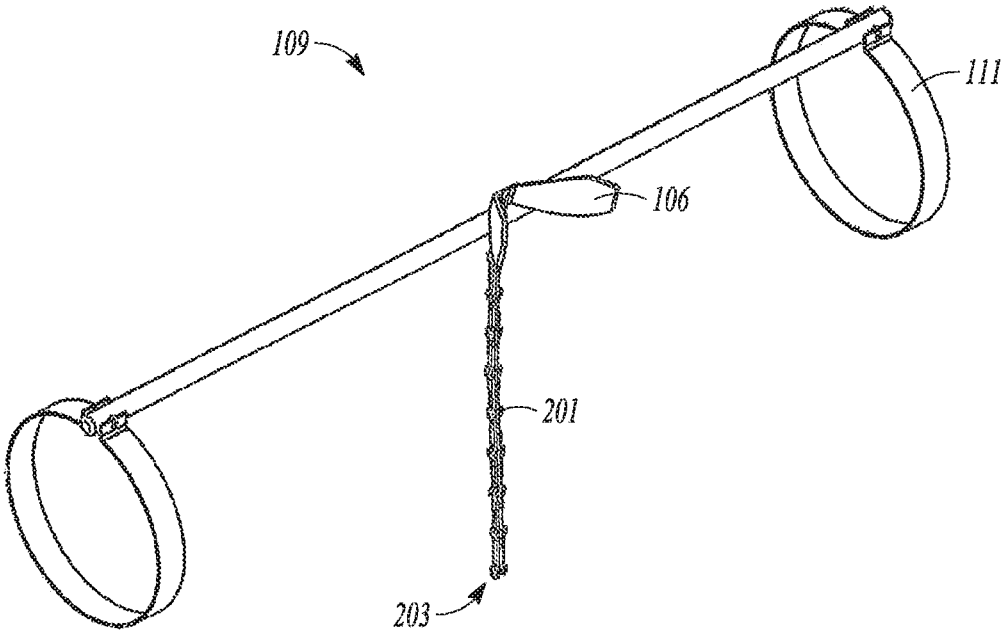
FIG. 7 is a perspective view of the lifting element with a mastoid process harness and a shoulder harness, according to an example.

In an example, the lifting element 109 can include an interface, such as for engaging a specified portion of the subject's anatomy for lifting to assist in inhalation. In an example, the interface with a subject for inhalation can include a mastoid process harness 106. The mastoid process harness 106 can be configured to harness the subject's mastoid process or occipital bone of the skull (or both), such as to help control the movement of the mastoid process or occipital bone, or the movement of the sternocleidomastiod or scalene muscle (or both), such as to assist in inhalation. In an example, the interface with a subject for inhalation can include a shoulder harness 111 (such as shown in FIG. 7). In other examples, the interface with a subject for inhalation can include a harness configured for harnessing one or more of: the xiphoid region, the sternum region, the upper abdominal region, the interchondral region, the costal cartilage region, the clavicle region, the thoracic region, the shoulder region, the upper limb region, the neck region, the occipital bone region, or the skull region. In an example, a single lifting element 109 can harness one or two or more of these options. In an example, the interface with a subject for inhalation can include an abdominal pad 113. The interface with a subject for inhalation can be coupled to the cyclical member 105, such as to drive the interface to achieve the desired respiration assistance.

In an example, the inhalation element 102 can include a quick-release 108, such as can be configured to allow the subject to readily disengage the lifting element 109 from the subject, or the cyclical member 105.

Figure 10A:
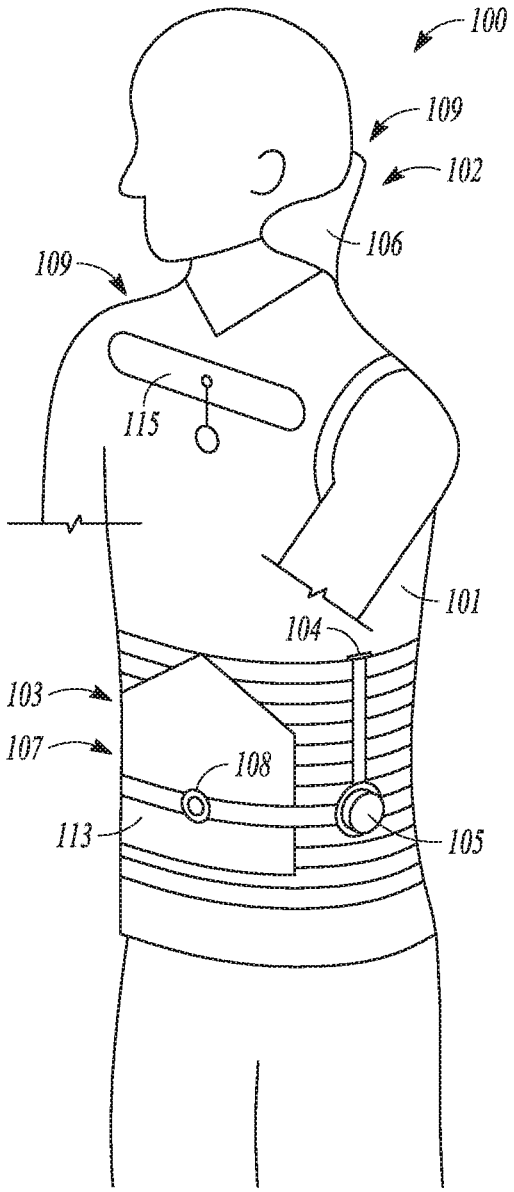
FIG. 10A is a perspective view of a respiration-assistance apparatus with the cyclical member on the side of the subject, according to an example.

In an example, the lifting element 109 can include a vacuum element 115 (shown in FIG. 10A). The vacuum element 115 can be an interface that is placed on the subject's chest. The interface can create a vacuum, negative pressure, or suction between itself and the subject's chest, such that interface's movement can control the movement of the subject's chest. The interface can be coupled to the cyclical member 105, such as to control the interface's movement. The interface can be pulled or pushed in a generally superior or inferior direction, such as to cyclically lift and lower the subject's thorax or chest.

In an example, the exhalation element 103 can include an interface, such as for engaging a specified portion of the subject's anatomy for compression to assist in exhalation. In an example, the interface with a subject for exhalation can include an abdominal pad 113. The abdominal pad 113 can be configured to compress the abdomen of the subject, such as to help control the abdomen's movement, such as during exhalation. In an example, the interface can include one or more straps. In an example, the compression element 107 can have an interface on the subject's ribcage, chest, or sternum. In an example, the compression element 107 can have an interface on the subject's on more than one portion of the subject's anatomy. In an example, the compression element 107 can have more than one interface on the subject. The interface that can be in contact with the subject can be coupled to an actuator, such as to drive the interface to actuate the desired respiration assistance. In an example, the exhalation element 103 can include a quick-release 108, such as can be configured to allow the subject to readily disengage the compression element 107 from the cyclical member 105.

The inhalation element 102 can be used to aid the inhalation cycle of the subject. The interface with the subject can include a shoulder or chest harness 111 such as to enable the lifting element 109 to push, pull, or lift the subject's head, neck, shoulders, chest, interchondral cartilage, ribs, sternum, or clavicle in a superior direction, such as to lift the sternocleidomastoid muscle, or the scalene muscles. Lifting the subject's sternocleidomastoid muscle or the scalene muscles can lift the subject's chest or thorax. Each of the different inhalation element 102 examples can result in the subject's chest or thorax lifting. The subject's chest or thorax lifting can create a negative pressure inside the subject's lungs. The negative pressure inside the subject's lungs can fill with air.

The exhalation element 103 can be used to aid the exhalation cycle of the subject. In an example, the interface on the subject's abdomen or ribcage can be moved in a posterior direction. Moving the interface in a posterior direction can result in compression of the subject's abdomen or ribcage. The compression on the subject's abdomen or ribcage can result in the subject's diaphragm moving towards the subject's lungs. The existing air in the subject's lungs can be pushed out of the subject's body through the subject's mouth or nose. In an example, the interface can be pulled in a posterior direction. In an example, the actuator can be positioned on the anterior side of the subject. The interface can be pushed in a posterior direction. In an example, the actuator can be positioned on the anterior side of the subject. The interface can be pulled in a posterior direction, such as with the use of a pulley.

In an example, the respiration-assistance apparatus 100 can be used with additional medical devices such as an oxygen mask, a pulse oximeter, a blood pressure cuff, or a thermometer. In an example, the respiration-assistance apparatus 100 can include a power source, such as a battery, an AC power plug, compressed gas, steam, hydraulic, liquid fuels, solid fuels, nuclear, solar, or a combination of power sources.

Figure 6:
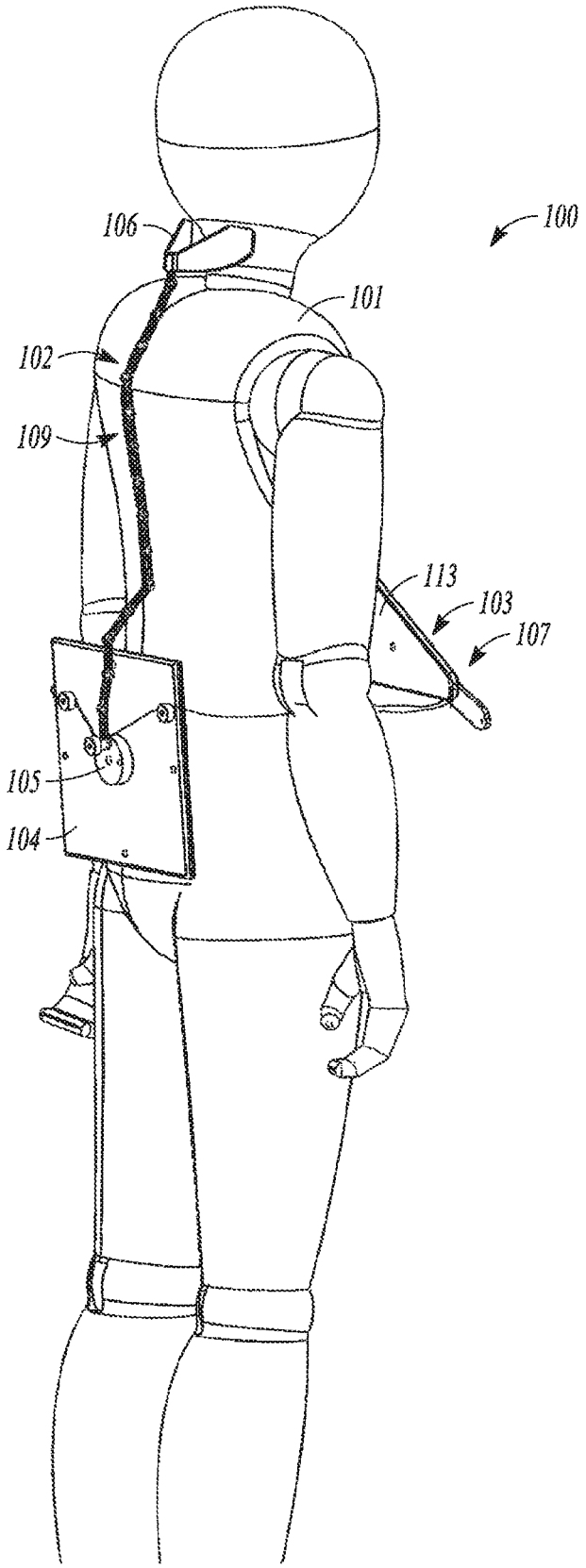
FIG. 6 is a perspective view of a respiration-assistance apparatus, according to an example.

FIG. 6 represents a perspective view of the vest-like garment 101 example and portions of an environment where it can be used. The garment 101 can support a lifting element 109. In an example, the garment 101 can support a rigid coupling 201 between the cyclical member 105 and the mastoid process harness 106. The cyclical member 105 can be on the anterior or posterior side of the subject.

Figure 8A:
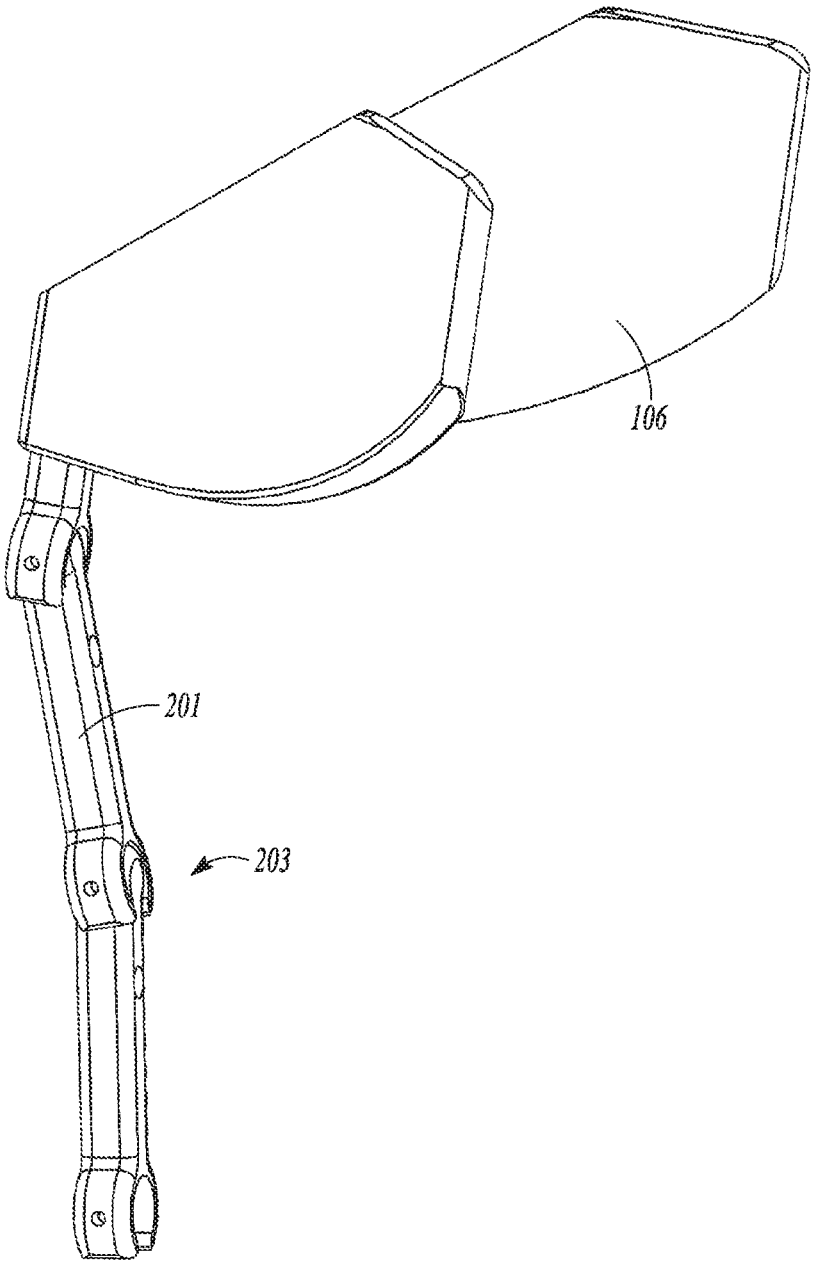
FIG. 8A is a perspective view of the lifting element with a mastoid process harness, according to an example.
Figure 8B:
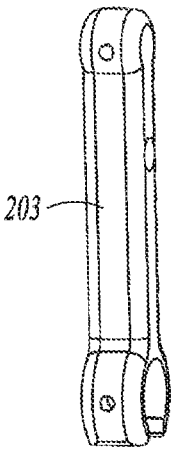
FIG. 8B is a perspective view of a single link of the rigid coupling.

FIG. 7 and FIG. 8A represent examples of the lifting element 109. FIG. 8B represents a link 203 in the coupling 201 between the cyclical member 105 and a mastoid process harness 106. The lifting element 109 can include a rigid coupling 201, a mastoid process harness 106, and a shoulder harness 111. In an example, the rigid coupling 201 can include multiple links 203. The multiple links 203 can be coupled together, such as to provide the ability to arrange and configure the rigid coupling's 201 shape to the subject's needs.

Figure 9:
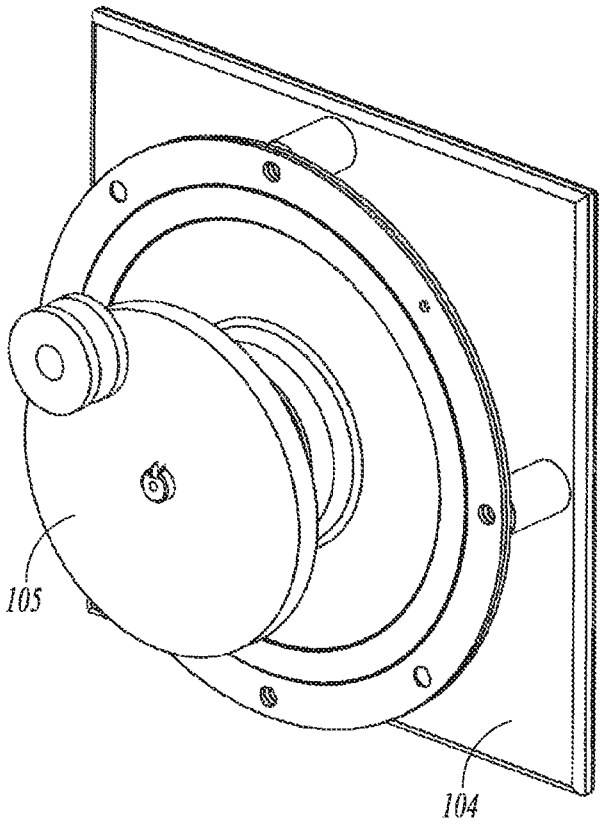
FIG. 9 is a perspective view of a cyclical member, according to an example.

FIG. 9 represents an example of a cyclical member 105. In an example, the cyclical member 105 can be a cam. There can be a motor driving the cam. The speed of the motor can affect the speed at which the cam rotates. The motor can be adjusted to affect the cam. The motor can be constant speed or variable speed.

Figure 10B:
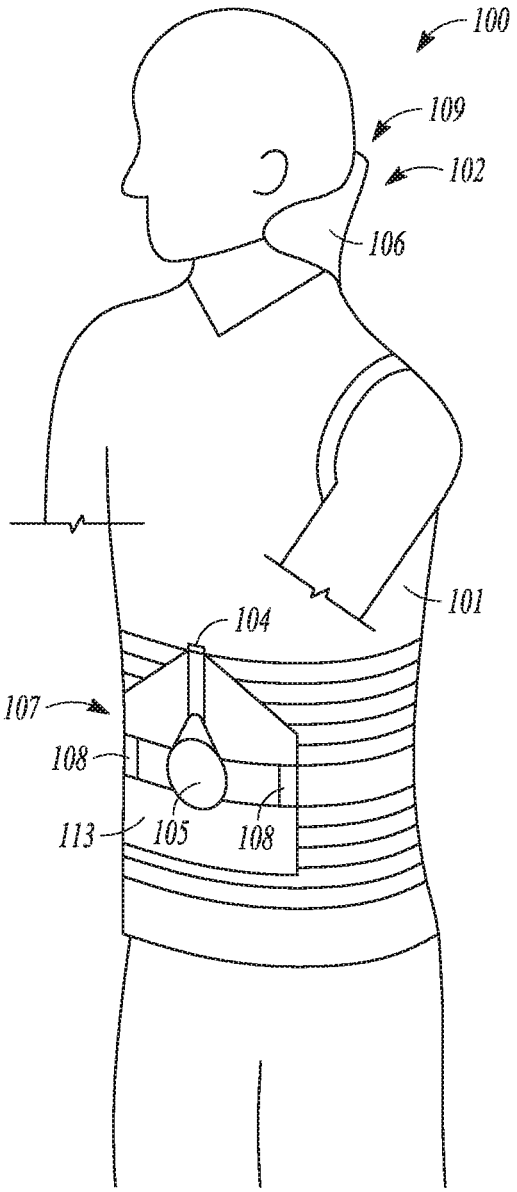
FIG. 10B is a perspective view of a respiration-assistance apparatus with the cyclical member on the anterior side of the subject, according to an example.
Figure 10C:
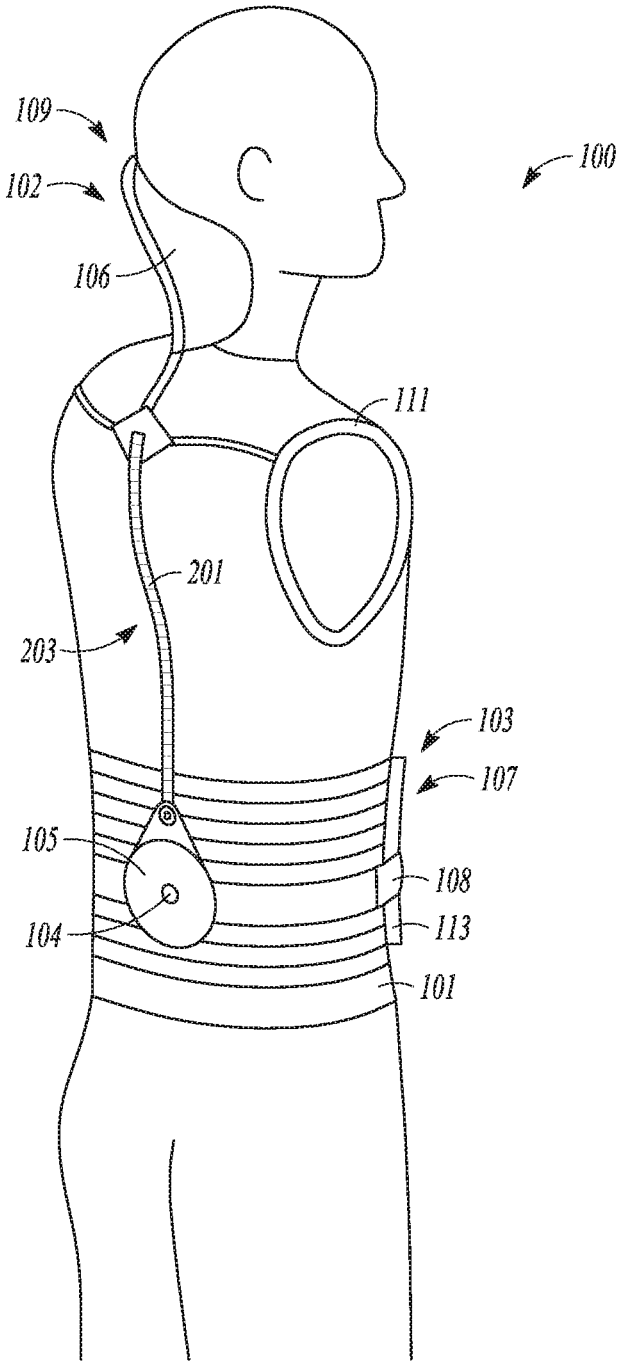
FIG. 10C is a perspective view of a respiration-assistance apparatus with the cyclical member on the posterior side of the subject, according to an example.

FIG. 10A, FIG. 10B, and FIG. 10C represent an example of the respiration-assistance apparatus 100 and portions of an environment where it can be used. In an example shown in FIG. 10A, the respiration-assistance apparatus can include the cyclical member 105 on a side of the subject. In an example, there can be a cyclical member 105 on each side of the subject, such as on the right lateral side and the left lateral side. The apparatus can also include a vacuum element 115 on the subject's chest. In an example, the abdominal pad 113 can assist in a subject's inhalation cycle, exhalation cycle, or both. The abdominal pad 113 can be moved in a generally superior direction in order to lift the chest, such as to create a negative pressure in the subject's lungs and induce inhalation. FIG. 10B represents an apparatus that can include the cyclical member 105 on the anterior side of the subject. FIG. 10C represents an apparatus that can include the cyclical member 105 on the posterior side of the subject.

Wheelchair Example

Figure 11:
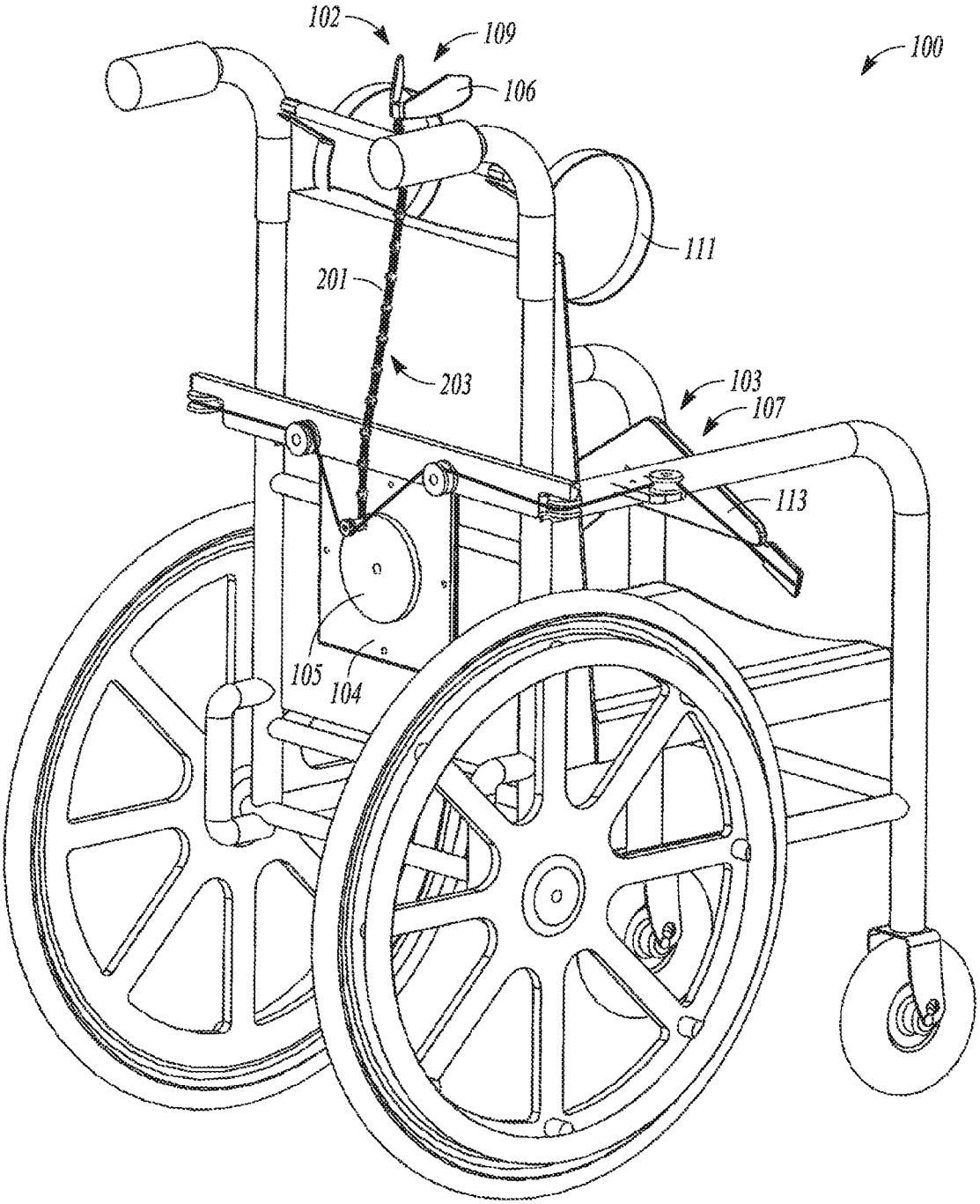
FIG. 11 is a perspective view of a respiration-assistance apparatus configured to fit a wheelchair, according to an example.

FIG. 11 represents an example where the respiration-assistance apparatus 100 can be designed to fit on a wheelchair and portions of an environment where it can be used. In an example, the apparatus 100 can be designed to fit a chair. The respiration-assistance apparatus 100 can include a reference element 104, such as to provide a fixed reference with respect to the subject. In an example, the reference element 104 can be located on the seatback of the wheelchair. In an example, the reference element 104 can be located between the seatback of the chair and the subject. In an example, the reference element 104 can be located underneath the seat of the chair.

In an example, the respiration-assistance apparatus 100 can include a cyclical member 105. In an example, the cyclical member 105 can be located on the seatback. In other examples, the cyclical member 105 can be located between the subject and the seatback or in front of the subject.

The respiration-assistance apparatus 100 designed to fit on a wheelchair can include an inhalation element 102, an exhalation element 103, or both. The inhalation element 102 can include a lifting element 109. The lifting element 109 can be located on the seatback (shown in FIG. 3), between the subject and the seatback of the chair, or in front of the subject. The exhalation element 103 can include a compression element 107. The compression element 107 can encircle only the subject, the subject and the chair, or neither the subject nor the chair. The cyclical member 105 can be coupled to the lifting element 109, such as to control the movement of the lifting element 109. The cyclical member 105 can be coupled to the compression element 107, such as to control the movement of the compression element 107.

Figure 12:
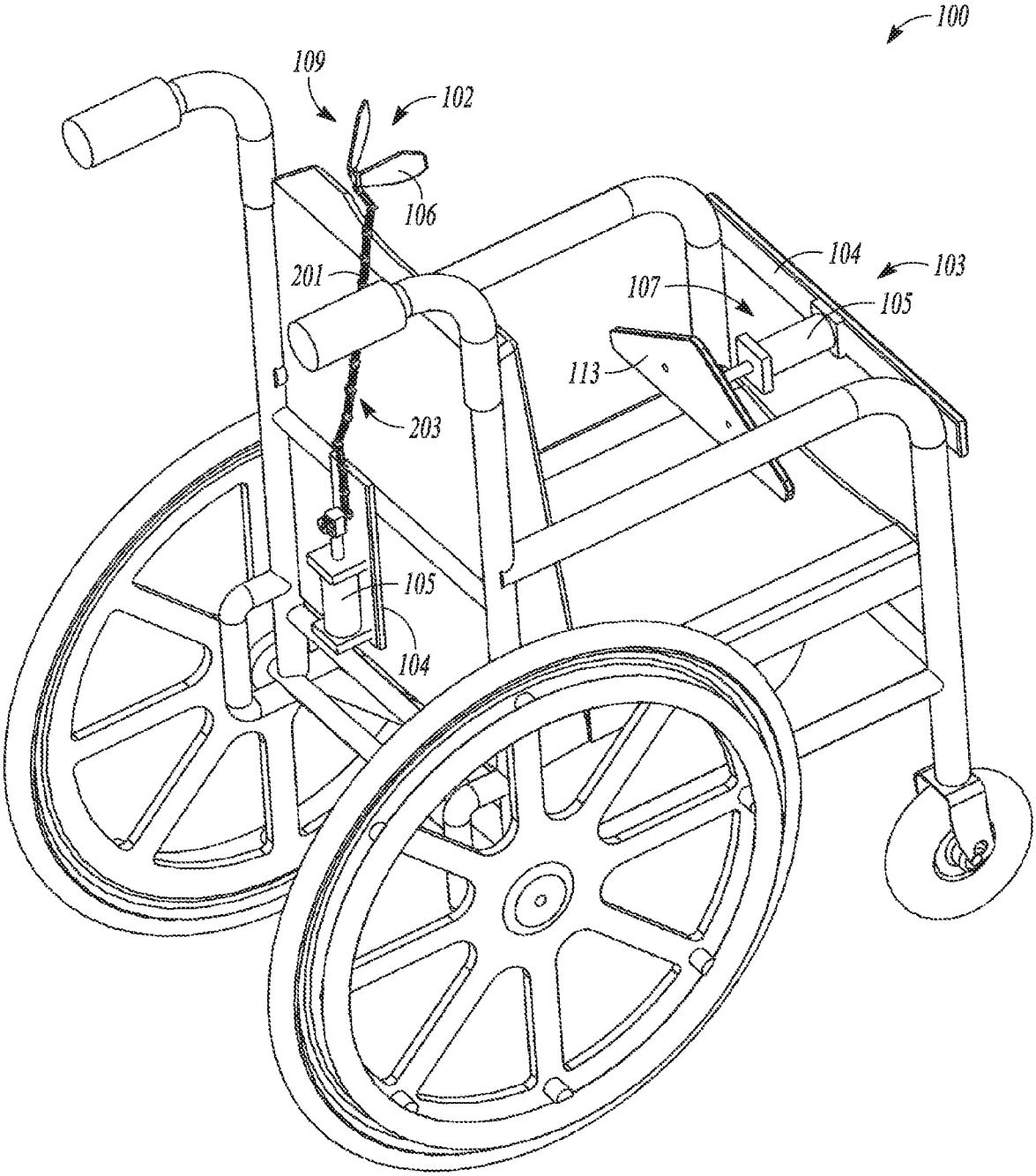
FIG. 12 is a perspective view of a respiration-assistance apparatus configured to fit a wheelchair, according to an example.

FIG. 12 represents an example where the respiration-assistance apparatus 100 can be designed to fit on a wheelchair and portions of an environment where it can be used. In an example, the respiration-assistance apparatus 100 can have two or more reference elements 104. In an example, the respiration-assistance apparatus 100 can have two or more cyclical members 105. The cyclical member 105 can be a piston. The piston can be air powered. The piston can be driven by a motor.

Bed Example

Figure 13:
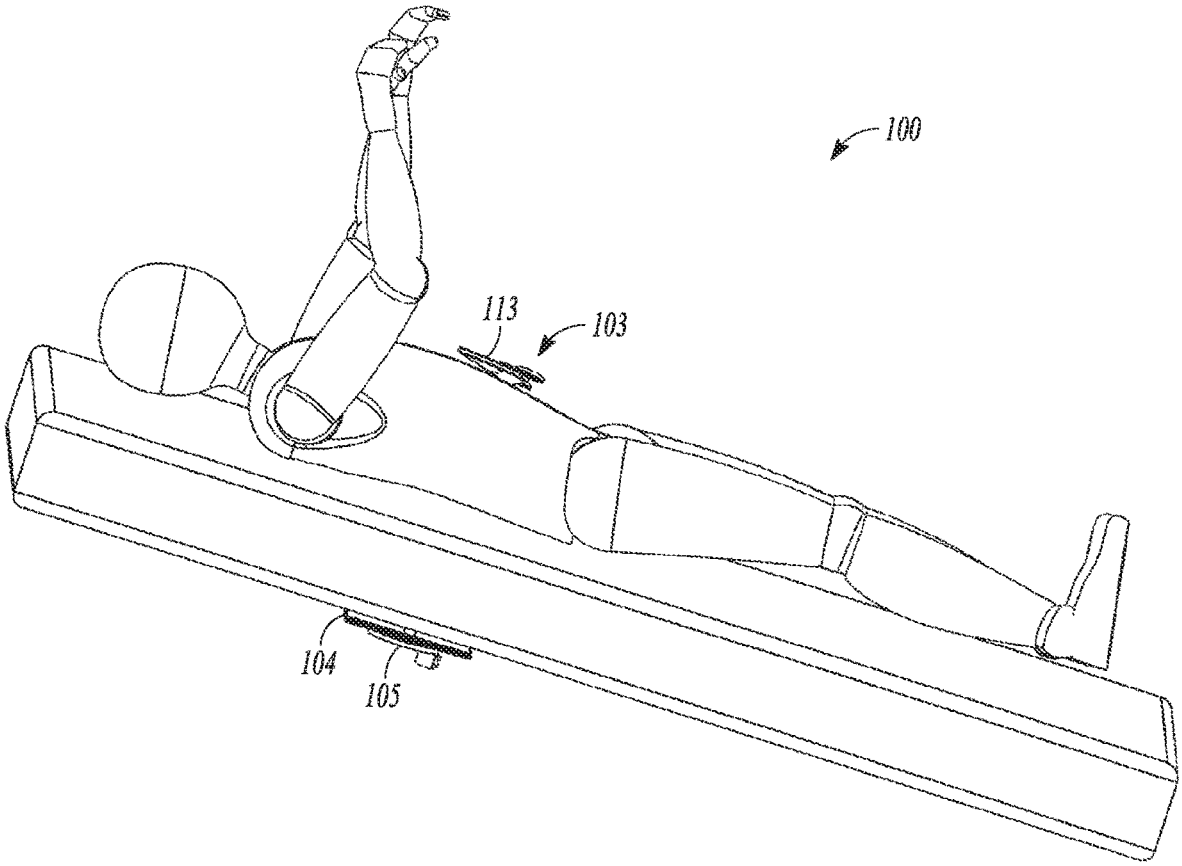
FIG. 13 is a perspective view of a respiration-assistance apparatus configured to fit a bed, according to an example.

FIG. 13 represents an example where the respiration-assistance apparatus 100 can be designed to fit a bed and portions of an environment where it can be used. The respiration-assistance apparatus 100 can also be designed to fit a hospital bed or operating table. The respiration-assistance apparatus 100 can include a reference element 104. In an example where the apparatus is designed to fit a bed, the reference element 104 can be located underneath the bed. In an example, the reference element 104 can be located between the bed and the subject. In an example, the apparatus 100 can include a cyclical member 105. The cyclical member 105 can be located underneath the bed, between the bed and the subject or in front of the subject. The respiration-assistance apparatus can include an inhalation element 102, an exhalation element 103, or both. The inhalation element 102 can include a lifting element 109. The lifting element 109 can be located underneath the bed, between the bed and the subject or on the opposite side of the subject from the bed. The exhalation element 103 can include a compression element 107. The compression element 107 can encircle only the subject, the subject and the bed, or neither the subject nor the bed. The cyclical member 105 can be coupled to the lifting element 109, such as to control the movement of the lifting element 109. The cyclical member 105 can be coupled to the compression element 107, such as to control the movement of the compression element 107.

Backboard Example

In an example, the respiration-assistance apparatus 100 can be designed to fit a backboard, or the apparatus 100 can have a backboard built into the apparatus 100, such as to aid a subject with spinal or neck injuries. The respiration-assistance apparatus 100 can include a reference element 104. In an example where the apparatus is designed to fit a backboard, the reference element 104 can be located between the board and the subject, on the anterior side of the subject, or on the opposite side of the backboard from the subject. In an example, the respiration apparatus can include an inhalation element 102, an exhalation element 103, or both. In an example, the respiration assistance apparatus can include a cyclical member 105. The inhalation element 102 can include a lifting element 109. The preferred lifting element 109 can include a shoulder harness 11, a vacuum element 115, or both, such as to keep the head and neck stable during the inhalation portion of a respiration cycle. The exhalation element 103 can include a compression element 107. In an example, the cyclical member 105 can be sped up or slowed down in order to meet the subject's respiration needs. In an example, the cyclical member 105 could produce 12-20 respiration cycles per minute. The cyclical member 105 could produce 20-120 cycles per minute such as in the need of CPR or rescue breathing. In an example, the compression element 107 can include a strap over the subject's chest, which could aid in chest compressions during CPR.

Vacuum Example

In an example, the respiration-assistance apparatus 100 can include a reciprocating element. The reciprocating element can include a vacuum element 115. The vacuum element 115 can aid the inhalation cycle, the exhalation cycle, or both cycles. In an example, the apparatus can include a reference element 104 and a cyclical member 105. The vacuum element 115 can be placed on the subject's abdomen or chest. In an example, three vacuum elements 115 can be used, such as (1) an upper vacuum element 115 on the subject's chest, (2) a lower vacuum element 115 on the subject's abdomen, and (3) a middle vacuum element in between the upper vacuum element 115 and the lower vacuum element 115.

A vacuum, negative pressure, or suction can be created between the vacuum element 115 and the subject's abdomen, such that the movement of the vacuum element 115 can control the movement of the subject's chest. The cyclical member 105 can be coupled to the vacuum element 115, such as to control the movement of the vacuum element 115. The vacuum element 115 can be moved in a generally anterior direction or a generally posterior direction. The movement of the vacuum element 115 in a generally posterior direction can compresses the abdomen, such as to induce exhalation. The movement of the vacuum element 115 in a generally anterior direction can lift the abdomen, which can create a negative pressure in the subject's lungs, such as to induce inhalation. In an example, the vacuum element 115 can be placed on the subject's chest and moved in a generally superior direction or a generally inferior direction, such as to create a thoracic movement similar to the natural movement of the body. The vacuum element 115 can reciprocate the thoracic structure in a generally superior and generally inferior direction. In an example, more than one vacuum element 115 can be used on a subject.

Manually Operated Example

In an example, the inhalation element 102, the exhalation element 103, or both can be powered by the subject, such as by the subject providing the necessary energy. The subject can provide the necessary energy, such as by pushing or pulling on a handle. The handle can be coupled to the compression element 107, lifting element 109, or both. In an example, a handle can be coupled to the compression element 107 and a different handle can be coupled to the lifting element 109.

In an example, the compression element 107 can apply pressure to the abdomen, when the subject moves the handle in a certain direction. In an example the lifting element 109 can lift a portion of the subject when the subject moves the handle in a certain direction. A manually operated example, can allow the subject to apply the appropriate amount of force at the appropriate timing to meet the subject's respiration needs.

Additional Notes & Examples

Among other things, the present subject matter can include or use an apparatus that can provide containment and movement such as during a cycle of movements of the abdominal or thoracic region. The cycle of movements of the apparatus can apply external pressures such as to various body regions. The external pressures can translate into internal volume and pressure changes, such as to assist respiration or circulation.

In an example, the present subject matter can include or use a mechanical device that can provide containment by a wearable garment such as a vest or pelvic skirt or other wearable garment that can serve as a reference element, and movement to the abdomen, or to the abdomen and the thorax, such as using an abdominal pad that can be connected to an element for providing movement, such as relative to the reference element. The element for providing movement can include an actuator and a cyclical moving element.

In an example, a cyclical element can produce a cycle of movements that can include cyclical posterior-anterior reciprocal movements, such as using a mechanical actuator and rotary motion cam, or such as using a mechanical actuator and a linear drive.

Different respiratory needs can involve different pressure changes that can vary from quiet breathing through to active breathing with increased ventilatory load. Therefore, additional or alternative settings can involve, posterior-superior or inferior-anterior movements, or both, such as to the abdomen or to the abdomen and thorax. In an example of increased ventilatory load, beginning with exhalation, such movements can compress the abdominal region, and then can compress and lift the lower floating rib region, such as using an abdominal-thoracic pad coupled with an actuator and an attached multi-action cam cyclical element, the actuator can continue rotating, while a surface of the cam provides a dwell period, as the multi-action cam continues to rotate, inspiration begins while the lifting surface begins to lower or retract the thoracic portion of the pad concurrent with the compression surface of the cam retracting or releasing compression of the abdominal portion of the thoracic-abdominal pad. This can produce a directional mechanical contraction and retraction of the abdomen and a lifting and lowering of the thorax. This, in turn, can effect directional movements and pressure changes, which can mimic or otherwise be similar to the body's natural physiologic variations such as during healthy respiration and circulation. Thus, the present systems, devices, and methods can be used to mechanically reproduce or augment a complete cycle of movements and pressure changes such as to assist respiration or circulation.

In an example, the present subject matter can include or use an apparatus having a cyclical action that can apply a direct reciprocating force to provide at least one of: compression or decompression of the abdomen, lifting or lowering of the thorax, realigning, extension, or retraction of the cranial region, such as during and within a particular respiration cycle.

In an example, the present subject matter can include or use an apparatus that can be configured to apply direct or indirect external mechanical pressure to the thoracic and abdominal regions, such as to assist the body's thoracic pump mechanism using a lifting element or compression element that can be configured to apply a series of movements for effecting or augmenting changing cardiorespiratory volumes or pressures such as by applying a reciprocating movement to the body.

In an example, the present subject matter can include or use a device that can be configured to produce a cycle of directional movements. The movements can be described through four different phases. Phase 1 (expiration) can begin with an inward directional movement of a xiphoid or abdominal pad or other compression element that can apply compression to the anterior abdominal surface, such as while a vest or other wearable garment that can serve as a containment portion of the device can support or contain the posterior portion of the abdomen. This can create an abdominal pressure. The abdominal pressure can displace the abdominal contents. This displacement can cause the diaphragm to elevate. Causing the diaphragm to elevate can effect a decrease in thoracic volume and an increase in intrathoracic pressure. This can produce exhalation. Phase 2, which can follow Phase 1, can then slow the directional movement provided by the device, such as to a pause. The slowing or pause can allow the intrathoracic and atmospheric pressures to equalize. Phase 3, which can follow Phase 2, can begin the inspiration portion of the cycle. Phase 3 can continue with a reversing of the directional movement provided by the device. For example, Phase 3 can provide a decompression of the abdominal pad concurrent with a lifting motion that can be provided to at least one of the shoulder region, the xiphoid region, the sternum region, the interchondral cartilage region, or the thoracic region. The decompression and lifting can expand the volume of the thoracic cage. This can create a negative intrathoracic pressure, which can produce inspiration. During Phase 4, which can follow Phase 3, the device can slow or pause the directional movement as the device completes its abdominal decompression and thoracic lift. This can permit the atmospheric and intrathoracic pressures to equalize, and the direction of movement can then be reversed, such as by returning to Phase 1.

Thus, after a particular cycle (e.g., Phases 1, 2, 3, and 4) providing a sequence of various movements is completed, the next cycle can commence with a sequence of movements such as described herein with respect to Phase 1. As explained herein, during Phase 1, the device can begin to lower and retract the thoracic cage. The inward directional movement of the abdominal surface would be the beginning of the subsequent expiration portion of the next respiration cycle, and would be the beginning of the next cycle of the respiratory assist device. In this way, the present respiratory assistance device can mechanically help move the various body regions such as to effect a rhythmic cycle of changing volumes and changing pressures of respiration or circulation assistance. In an example, the timing for a typical cycle of respiration can be programmably adjusted, such as to provide a breathing rate that can be specified at a value between 12 breaths per minute and 20 breaths per minute. However, other settings can be used, and such other settings can have different timing, pressure, or durations of all or a portion of a phase or sequence of a respiration cycle.

In an example, the present subject matter can include or use a respiration assistance device that can affect the body's internal pressures. This can include applying one or more external pressures, such as by using one or more elements that can be connected to a cyclical element. The one or more elements can support, contain, or enclose or otherwise be used to apply a pressure to a portion or a region of the body that can affect respiration or circulation.

In an example, the present subject matter can include or use an apparatus that can include or use an abdominal pad. The abdominal pad can be sized, shaped, or otherwise configured to fit below the xiphoid process or the ribs, or both. The abdominal pad can be sized, shaped, or otherwise configured to provide a surface area that can be sized to be wide enough to fit against, cover, or enclose and compress the abdominal muscles of expiration. The abdominal pad can be sized, shaped, or otherwise configured in height to fit between the pelvis and xiphoid process. The pad can be sized, shaped, or otherwise configured to fit against, cover, or enclose the muscles of the abdomen, and also to fit directly below and under the xiphoid and between the lower ribs and costal cartilage of the ribs. The pad can be configured having two separable and joinable portions, such that a lower abdominal pad can include a horizontal separation between an upper thoracic pad. The two pads can interact and can extend and retract. This can help the pad effect a lift of the thorax during the inhalation portion of respiration. It can allow the pad to optionally serve a dual purpose, one being compressing the abdomen during the exhalation portion of the respiratory cycle, the other being decompressing the abdomen while lifting the thorax, during the inhalation portion of the respiratory cycle.

In an example, the present subject matter can include or use an apparatus that can include or use an adjustable spinal support element. The adjustable spinal support element can be sized, shaped, or otherwise configured to provide support or traction for the spinal column. The spinal support element can also be sized, shaped, or otherwise configured to provide a secure, stable location to which one or more additional accessory devices can attach.

In an example, the present subject matter can include or use an apparatus that can include or use an adjustable spinal support element that can include one or more joints that can be sized, shaped, or otherwise configured to provide an adjustable amount of movement or flexibility, such as to permit rotation or curving of the spinal support element. In an example, the adjustment can range between 0 degrees and 90 degrees in rotation or arc. In an example, the adjustable spinal support element can include a locking mechanism, such as to allow one or more joints to be locked individually, or to allow any combination of joints to be locked using one lever. In an example, the center of the spinal support element can be configured to include a flexible connector, such as extending through the center portion of each joint. Each joint can have a friction portion, such as can be located at its area of rotation.

In an example, the present subject matter can include or use an apparatus that can include or use a spinal support element that can have a piston or other extendable portion located between adjacent joints. The piston or other extendable portion can be sized, shaped or otherwise configured to provide a distance of travel that can be adjusted, such as from zero inches up to several inches. This can permit the length of the spinal support element to be adjusted to various body sizes and shapes, yet can be adjustable or lockable, such as to provide support or stability, such as in case of spinal trauma or loss of consciousness.

In an example, the present subject matter can include or use an apparatus that can include or use a vest or other suit. In an example, the vest can be sized, shaped, or otherwise configured to encircle or contain the circumference of the abdomen, the ribs, the shoulder area, and the sternum or clavicle. In an example, a vest can include a cyclical element, such as can be built into the abdominal region. The cyclical element can be configured to provide a four phase cardiopulmonary or respiration assistance or other cycle, such as can include (1) compression, (2) pause, (3) decompress, and (4) pause. In an example, the cycle can include a speed control range that can be configured to provide between 10 breaths per minute and 30 breaths per minute, or between 10 compressions per minute and 120 compressions per minute, such as for CPR. A vest can include a flexible portion between an abdominal compression portion and a rib or sternum elevating portion. The vest can help effect movement, such as a reciprocating posterior compression of the abdomen, a reciprocating lifting movement of the thoracic region, or both. The vest can be configured to provide the thoracic movement, such as reciprocating away from and closer to the abdominal region. In an example, the vest can include or contain a spinal support. In an example, the vest can include a reinforced or other stiff area that can be configured to accept attachment of one or more portions of a respiration assistance apparatus. The vest can include one or more reinforced areas that can be sized, shaped, or otherwise configured such that one or more actuators or cyclical elements can attach thereto. This can help, for example, for a subject having a condition such as cystic fibrosis. In an example, an external reciprocating actuator and cyclical element can be configured or arranged to additionally or alternatively provide a massaging action, such as by rotating the multi-lobe cam described herein. In an example, the vest can include a physiologic monitor or physiologic therapy circuit, such as can include, by way of example, but not by way of limitation, one or any combination an oximeter, a blood pressure sensor, a temperature sensor, a pulse sensor, a phrenic nerve stimulator, or the like. In an example, the vest can include a communication portal, such as for allowing unidirectional or bidirectional communication with a local or remote ancillary device.

In an example, the present subject matter can include or use an apparatus that can include or use a respiration assistance device that can affect the body's internal lung pressure, such as by application of one or more external pressures such as by one or more elements that can be connected to a cyclical element. The one or more elements can press against, cover, contain, or enclose a portion or a region of the body that affects respiration or circulation, such as to effect a desired pressure change of the body.

In an example, if the subject's diaphragm is active, the diaphragmatic movement can be directed by the body, and the externally applied pressure can assist the internal pressures. If the diaphragm is paralyzed or otherwise inactive, the sequence of movements and externally applied pressures can effect the directional movement of the diaphragm and can effect the changing pressures on either side of the diaphragm.

In an example, the present subject matter can include or use an apparatus that can be configured to provide a sequence of external movements and pressures to the abdomen or the thorax in an alternating sequence, in parallel, or a variation or combination of these two sequences. In an alternating sequence example, during relaxed respiration, pressures can be applied in an alternating sequence of thoracic lift followed by a release of lift and then a compression of the abdomen, pausing, then cycling on to release abdominal compression and apply thoracic lift. In a parallel sequence example, such as during active or labored respiration, abdominal compression pressures can be applied in parallel (e.g., overlapping or concurrent) with a pulling pressure that can be applied to the thorax such as to replicate exhalation. Then, these concurrent pressures can slow to a pause during end exhalation. Then, both compressions can be released. Then, abdominal decompression can be commenced in parallel with thoracic lift that translates into increased inspiration.

The configuration of the cyclical element, or the settings of the controller, can be configured to operate within the parameters of the body's natural pressure ranges, speeds, pauses, and sequence of movements during a cycle of respiration. The elements can be configured to move the body surfaces with external changing pressures. This can translate into internal movements and pressure changes within the thorax and abdomen. A mechanical controller can be configured to direct the movements by a change of the shape of the surfaces of the multi-action cam, such as to determine the sequence of movements of the attached correlating elements. The multi action cam can be configured to effect four separate sequences throughout a cycle. The configuration of the multi-action cam can use the shape of its surfaces to effect a sequence of events by way of shape throughout a rotation. An exhalation portion or percentage of a certain portion of a surface can have an increasing dimension that can move its corresponding abdominal pad and compression element with a greater change of dimension. A subsequent pause portion or percentage of the same surface can follow, such as to provide a pause that can have an unchanging dimension. A subsequent inspiration portion or percentage of a certain portion of the same surface can have an decreasing dimension. This can be used to moves its corresponding abdominal pad and decompression element with a reversing change of direction. The path of the surface can return it back to the same plane of the beginning of the expiration surface. The end of the decreasing inspiration surface can include a pause portion or percentage of surface that can contain an unchanging dimension on the surface. The percentage of surface that each of the four portions use can determine the percentage of time used during one rotation. One rotation can correspond to one cycle. Various surfaces can be configured within one multi action cam and each surface can be configured with changing shapes to effect a separate cycle of compression, pause, decompression, pause, or lift, pause, lower, pause. The rotary actuator driving the multi-action cam can have its speed, pressure and pauses controlled by a controller with variable switches, however the speed of the actuator can only control the speed of the cycle and the configuration of the multi-action cam can control the percentage of time spent throughout a cycle.

In an example, the present subject matter can include or use an apparatus that can be configured to provide one or more ancillary functions, such as mechanically assisted talking, singing, coughing, sneezing, vomiting, or defecating, which can include use of the same containment or support elements and similar methods of movement for effecting compression or release. However, the pressure, pauses or dwell, speed, timing, or duration can be modified to provide a desired specified sequence of pressure changes such as during a cycle of natural unassisted respiration. This can be used to replace or augment nonfunctional muscular contractions with mechanically produced external movements. Such mechanically produced external movements can include the pressure, timing, dwell, or like parameter that can be controlled by one or more adjustable settings or mechanical configuration, or by computer logic. The parameters can be constrained to be within the limits of acceptable pressures for the body during breathing, or to be within the limits of acceptable pressures to produce a desired effect, such as a cough, a sneeze, vomiting, etc. In an example, the externally applied force and pressure changes can be patient activated and controlled, for example, as a feature of the control panel. In an example, the force and pressure changes can be increased for a specified number of a plurality of respiration cycles, or other specified duration of time, such as within one or more preset limits. After expiration of such period of time, or when the mechanically assisted respiratory device has reached one or more of its preset limits, it can revert back to its previously programmed cycle of changing dimensions and pressures for providing respiratory assistance.

In an example, the increase in force and pressure can be accomplished by one or more of: (1) an additional shape or profile or surface of the multi action cam or other cyclical element described herein, which can be configured to effect a greater change of dimension and movement and pressure; (2) an additional piston or other movable element, or additional actuator, that can be configured to provide an additional movement that can effect a greater change in volume and, therefore, a greater pressure change; an accompanying controller, such as an electrical controller circuit or a mechanical controller, can be configured to control one or more of the start, pressure, timing, dwell, or stop; (3) a pressure bypass device that can be configured to allow for a brief increase of pressure or vacuum directly to the exhalation or compression element; the bypass feature can include a safety feature such that the bypass feature can be timed to lock out and automatically return to normal function mode unless the bypass feature is reactivated by the user; (4) an actuator or other movable element can include an additional feature such as a dual extending piston, such as can be configured to increase the first distance of the piston or linear actuator, which, in turn, can be used to facilitate an increased change in dimension usable for one or more of the ancillary settings, such as the cough setting; or (5) an increase in pressure or vacuum can be provided, such as to affect the movement of the abdomen and thorax, such as in the vacuum element example.

In an example, the cyclical element can be configured to control one or more components such that one or more of the movement, pressure, timing, or duration can produce a sequence of events that can be controlled such that one or more of the timing, speed, dwell, movement, or pressure can be selected by the subject or a caregiver, such as to coincide with the body's natural sequence or range of pressures. The cyclical element and the multi-action cam can be configured with an automatic release device, which can be triggered when the cough, sneeze, vomit, or other ancillary feature is activated. In an example, the subject can activate the increased pressure feature, such as using a controller, however as a safety feature the activating mechanism can be configured such that continuous activation must be applied by the subject to keep the increased pressure active, e.g., when the activating mechanism is released by the subject, the configuration or tapered profile of the cyclical element can automatically return the drive mechanism to the previous setting or configuration.

In an example, the present subject matter can include or use a vest or other garment. A mechanical expansion and/or contraction device can be included in or attached to the vest, such as at the front of the vest, such as at a location corresponding to the abdominal area of the body. In an example, the expansion and/or contraction device can be mounted to or built into the vest such that, during the exhalation phase of the respiration cycle, a contractile force can encircle or otherwise be applied to the waist. The back portion of the vest can provide support while applying pressure to the abdomen. This can decrease the circumference of the waist. This can provide an overall compression to the abdominal area such as between the bony framework of the pelvis and the diaphragm. Such added compression can effect a rise of the diaphragm. This can compress the lungs, thereby facilitating exhalation.

During the remaining respiration and inspiration portions of the respiration cycle, the respiratory assistance device can decrease abdominal compression and can provide a lift motion into the thoracic cavity. This can include lifting the ribs and sternum, such as by the abdominal pad. The lift motion can be accomplished by the flexibility and support of the vest (e.g., relatively firmer support can be provided at the hip and lower abdominal area). At least a portion of the vest can be made flexible yet resilient (e.g., non-elastic) such as to provide a base for the device to lift from. The abdominal area of the vest can be made flexible enough to fit conformably about the abdomen, yet firm enough below the ribs and sternum to support the device and the xiphoid pad or rib pad.

The flexible and or elastic portion of the vest can be sized, shaped, or otherwise configured to be located between the pelvis, the ribs, and the sternum. This can allow the vest to flex, elongate, and elevate the thorax, such as in a lifting direction that allows the ribs and sternum and clavicle to rise, and the diaphragm to lower, thereby increasing the tidal volume or capacity of the lungs.

To provide the elasticity or flexibility desired at the abdomen, the mounting location of the mechanical device can be either on the xiphoid pad or lower, such as near the pelvis. In an example, a preferred location for the dual action inspiration/expiration device to be mounted onto can be the abdominal xiphoid pad because of the dual usage of the abdominal pad for compression of the abdomen and, during decompression, to provide lift to elevate the ribs and sternum and clavicle.

As patients have broader needs, the device can be configured to provide for a broader list of needs and sizes, such as ranging from infant through elderly. The size, shape, pressure ranges, additions, or options, can be adapted to the individual needs of a particular subject.

In an example, a paramedic version can include a flexible or rigid backboard, with spinal support, and spinal traction. An attachable assisted inhalation device can be provided. An attachable assisted abdominal compression device can be provided for exhalation, chest compression, or CPR. A vagus/phrenic nerve stimulator can be included. One or more additional physiological monitors can be included, such as for monitoring oxygen, temperature, blood pressure, or pulse. A control panel and built in screen and communication device can be included, such as to provide connection to a medical support center or hospital.

In an example, the device can be configured with a separable, flexible vest, and a built-in spinal support extension rod, an occipital/mastoid support pad, an inhalation device that can be detachably mounted at the base of the skull such as directly below the occipital bone and mastoid process, an attached chest compression device, an attached abdominal compression device, a vagus or phrenic nerve stimulator, a heater, an oxygen supply, one or more additional physiological monitors such as for one or any combination of oxygen, temperature, blood pressure, pulse, or other phyiological parameter. The devices can be attached to a controller. Each separate device can include an on/off or other control switch, such as can be centrally located and attached to a screen and communication center, such as for providing for a connection to a medical support center, such as via a wireless device. In an example, the vest can optionally include one or more of attached arm, wrist, or hand straps or cuffs.

In an example, the paramedic version can include built in hand holds, such as to allow a paramedic of other user the ability to slide a flexible backboard around the body or to enclose or support a patient or to apply traction. This can help provide spinal support, body containment, or activation of the various devices. This can help allow the user to immobilize and remove a patient from a confined space, such as while maintaining traction and body support. Automated thoracic elevation can be provided such together with assistance for inhalation, abdominal compressions for exhalation, chest compressions for CPR, spinal support, and thoracic lift, within one unit.

In an example, a vacuum pad can be provided, such as to vacuum seal to the upper chest cavity. The vacuum seal can be attached to an actuator, such as to actively drive the vacuum seal through the four stages of the breathing cycle. In an example, the vacuum pad can seal to the upper thoracic cavity, such as to the clavicle or sternum. The movements can operate with the mechanical procedure described herein, such as to provide movement in accordance with the directional movement of the sternocleidomastoid muscle, which pulls the sternum and clavicle in a slight arcing movement towards the mastoid process of skull.

In an example, a preferred model is portable, and can be used standing, sitting, sitting in a chair, or lying down, and can incorporate one or any combination of the options and features and additions described or shown herein.

A further non-limiting list of examples is provided below.

Example 1 can include or use subject matter (such as an apparatus, a method, a means for performing acts, or a machine readable medium including instructions that, when performed by the machine, that can cause the machine to perform acts), such as can include or use a respiration-assistance apparatus. The apparatus can include a lifting element. The lifting element can be configured to cyclically push, pull, or lift, toward a superior direction of the subject, at least one of a xiphoid region, a sternum region, an upper abdominal region, an interchondral region, a costal cartilage region, a clavicle region, a thorax region, a shoulder region, a upper limb region, a lower limb region, a neck region, or a skull region of a subject during an inhalation portion of a respiration cycle of the subject.

Example 2 can include or use, or can optionally be combined with the subject matter of Example 1 to include or use a reference element. The reference element can be configured to provide a fixed reference with respect to a subject. A cyclical member can couple the lifting element to the reference element such as to cyclically adjust a distance or dimension therebetween to effect the cyclical push, pull, or lift.

Example 3 can include or use, or can optionally be combined with the subject matter of one or any combination of Examples 1 or 2 to include or use a compression element. The compression element can be configured to apply a compression to a front of at least one of a ribcage region or an abdomen region of the subject during an exhalation portion of the respiration cycle of the subject in coordination with the cyclical push, pull, or lift of the lifting element.

Example 4 can include or use, or can optionally be combined with the subject matter of one or any combination of Examples 1 through 3 to include or use a reference element that can be configured to provide a fixed reference with respect to a subject. A cyclical member can be included. The cyclical member can include or can be coupled to an actuator. The actuator can be coupled to the lifting element and the compression element and coupled to the reference element. The actuator can be configured to actuate the lifting element to apply the push, pull or lift during the inhalation portion of the respiration cycle of the subject and to actuate the compression element to apply the compression during the exhalation portion of the respiration cycle of the subject in coordination with the cyclical push, pull, or lift of the lifting element.

Example 5 can include or use, or can optionally be combined with the subject matter of one or any combination of Examples 1 through 4 to include or use an actuator that can include or use a multi-action cam. The multi-action cam can be coupled to one or more of, the lifting element, the compression element, or the reference element.

Example 6 can include or use, or can optionally be combined with the subject matter of one or any combination of Examples 1 through 5 to include or use a cyclical member. The cyclical member can include or can be coupled to an actuator. The actuator can be coupled to the lifting element and coupled to the reference element, such as to actuate the lifting element to apply the push, pull or lift during the inhalation portion of the respiration cycle of the subject.

Example 7 can include or use, or can optionally be combined with the subject matter of one or any combination of Examples 1 through 6 to include or use an actuator. The actuator can include a cam. The cam can be coupled to the lifting element and can be coupled to the reference element.

Example 8 can include or use, or can optionally be combined with the subject matter of one or any combination of Examples 1 through 7 to include or use an actuator that can include a piston. The piston can be coupled to the lifting element and can be coupled to the reference element.

Example 9 can include or use, or can optionally be combined with the subject matter of one or any combination of Examples 1 through 8 to include or use a user-activatable quick-release, which can be configured to permit the user to disengage the lifting element from the actuator.

Example 10 can include or use, or can optionally be combined with the subject matter of one or any combination of Examples 1 through 9 to include or use a lifting element that can include a mastoid occipital bone interface that can be configured to push, pull, or lift the mastoid process during the inhalation portion of the respiration cycle of the subject.

Example 11 can include or use, or can optionally be combined with the subject matter of one or any combination of Examples 1 through 10 to include or use a lifting element that can include a shoulder strap that can be configured to push, pull, or lift a shoulder or clavicle during the inhalation portion of the respiration cycle of the subject.

Example 12 can include or use, or can optionally be combined with the subject matter of one or any combination of Examples 1 through 11 to include a lifting element that can include a vacuum or suction interface with the subject.

Example 13 can include or use, or can optionally be combined with the subject matter of one or any combination of Examples 1 through 12 to include or use a vest or other wearable garment that can include or that can be coupled to the lifting element.

Example 14 can include or use, or can optionally be combined with the subject matter of one or any combination of Examples 1 through 13 to include or use a wheelchair attachment that can include or can be coupled to the lifting element.

Example 15 can include or use, or can optionally be combined with the subject matter of one or any combination of Examples 1 through 14 to include or use a lifting element that can include a vertical shaft that can be coupled between the cyclical member and the subject.

Example 16 can include or use, or can optionally be combined with the subject matter of one or any combination of Examples 1 through 15 to include or use a vertical shaft that can be configured to have an adjustable length or length of travel.

Example 17 can include or use, or can optionally be combined with the subject matter of one or any combination of Examples 1 through 16 to include or use a lifting element that can include at least one of a shoulder harness, a chest harness, a forehead harness, or a mastoid process harness.

Example 18 can include or use, or can optionally be combined with the subject matter of one or any combination of Examples 1 through 17 to include or use a compression element. The compression element can include a pad that can be configured to be placed in contact with at least one of the subject's abdomen or ribcage. At least one band can continuous connect the actuator to the pad.

Example 19 can include or use, or can optionally be combined with the subject matter of one or any combination of Examples 1 through 18 to include or use a cyclical member that can be coupled to both the lifting element and the compression element throughout an entire rotation cycle of the cam.

Example 20 can include or use, or can optionally be combined with the subject matter of one or any combination of Examples 1 through 19 to include or use a cyclical member that can be configured to continually cycle throughout a respiration cycle of the subject.

Example 21 can include or use, or can optionally be combined with the subject matter of one or any combination of Examples 1 through 20 to include or use a cyclical member that can be configured to cycle at a constant speed to control both timing and a length of travel of at least one of the lifting element or the compression element.

Example 22 can include or use, or can optionally be combined with the subject matter of one or any combination of Examples 1 through 21 to include or use a motor that can be configured to drive the cyclical member.

Example 23 can include or use, or can optionally be combined with the subject matter of one or any combination of Examples 1 through 22 to include or use an automatic or manual safety release that can be configured for disengaging the lifting element or the compression element from the subject.

Example 24 can include or use, or can optionally be combined with the subject matter of one or any combination of Examples 1 through 23 to include or use subject matter (such as an apparatus, a method, a means for performing acts, or a machine readable medium including instructions that, when performed by the machine, that can cause the machine to perform acts), such as can include or use a respiration assistance apparatus. The respiration assistance apparatus can include a compression element that can be configured to apply a compression to a front of at least one of a ribcage region or an abdomen region of the subject during an exhalation portion of the respiration cycle of the subject. A cyclical member can be coupled to the compression element. The cyclical member can be configured to actuate the compression element to apply the compression during the exhalation cycle of the subject. The cyclical member can be continually coupled to the compression element throughout an entire cycle of the cyclical member.

Example 25 can include or use, or can optionally be combined with the subject matter of one or any combination of Examples 1 through 24 to include or use a reference element that can be configured to provide a fixed reference with respect to a subject. A cyclical member can couple the compression element to the reference element such as to cyclically adjust a distance or dimension therebetween to effect the cyclical compression.

Example 26 can include or use, or can optionally be combined with the subject matter of one or any combination of Examples 1 through 25 to include or use a compression element that can include at least one pad that can be configured to be placed in contact with at least one of the subject's abdomen or ribcage. At least one band can be continually coupled to the cyclical member and the pad.

Example 27 can include or use, or can optionally be combined with the subject matter of one or any combination of Examples 1 through 26 to include or use a lifting element that can be configured to pull or lift at least one of a xiphoid region, a sternum region, an upper abdominal region, an interchondral region, a costal cartilage region, a thorax region, a shoulder region, a upper limb region, a lower limb region, a neck region, or a skull region of a subject during an inhalation portion of a respiration cycle of the subject.

Example 28 can include or use, or can optionally be combined with the subject matter of one or any combination of Examples 1 through 27 to include or use a cyclical member that can be configured to continually cycle throughout a respiration cycle of the subject.

Example 29 can include or use, or can optionally be combined with the subject matter of one or any combination of Examples 1 through 28 to include or use a cyclical member that can be configured to cycle at a constant speed to control both timing and the length of travel of the compression element.

Example 30 can include or use, or can optionally be combined with the subject matter of one or any combination of Examples 1 through 29 to include or use a motor that can be configured to drive the cyclical member.

Example 31 can include or use, or can optionally be combined with the subject matter of one or any combination of Examples 1 through 30 to include or use an automatic or manual safety release that can be configured for disengaging the compression element from the subject.

Example 32 can include or use, or can optionally be combined with the subject matter of one or any combination of Examples 1 through 31 to include or use the lifting element that can include a vacuum or suction interface with the subject.

Example 33 can include or use, or can optionally be combined with the subject matter of one or any combination of Examples 1 through 32 to include or use subject matter (such as an apparatus, a method, a means for performing acts, or a machine readable medium including instructions that, when performed by the machine, that can cause the machine to perform acts), such as can include or use a respiration-assistance apparatus that can include a reciprocating element. The reciptrocating element can be configured to cyclically push and pull, toward an anterior, posterior, superior, or inferior direction, at least one of a xiphoid region, a sternum region, an upper abdominal region, an interchondral region, a costal cartilage region, a clavicle region, or a thorax region of a subject during a respiration cycle.

Example 34 can include or use, or can optionally be combined with the subject matter of one or any combination of Examples 1 through 33 to include or use subject matter that can include a reference element that can be configured to provide a fixed reference with respect to a subject. A cyclical member can couple the reciprocating element to the reference element such as to cyclically adjust a distance or dimension therebetween to effect the cyclical push, pull, or lift.

Example 35 can include or use, or can optionally be combined with the subject matter of one or any combination of Examples 1 through 34 to include or use a cyclical member that can include or can be coupled to an actuator. The actuator can be coupled to the reciprocating element and coupled to the reference element, such as to actuate the reciprocating element to apply the push, pull or lift during the inhalation portion of the respiration cycle of the subject and such as to apply the compression during the exhalation portion of the respiration cycle of the subject.

Example 36 can include or use, or can optionally be combined with the subject matter of one or any combination of Examples 1 through 35 to include or use a reciprocating element that can include a vacuum or suction element that can be configured to be placed in contact with the subject throughout a respiration cycle.

Example 37 can include or use, or can optionally be combined with the subject matter of one or any combination of Examples 1 through 36 to include or use a linkage that can couple the actuator to the reciprocating element.

Example 38 can include or use, or can optionally be combined with the subject matter of one or any combination of Examples 1 through 37 to include or use a linkage that can be made sufficiently rigid to push and pull the reciprocating element.

Example 39 can include or use, or can optionally be combined with the subject matter of one or any combination of Examples 1 through 38 to include or use an actuator that can include a cam that can be coupled to the linkage and that can be coupled to a reference element.

Example 40 can include or use, or can optionally be combined with the subject matter of one or any combination of Examples 1 through 39 to include or use an actuator that can include a piston that can be coupled to the linkage and coupled to a reference element.

These non-limiting numbered and unnumbered examples can be combined in any permutation or combination. The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A respiration assistance apparatus, comprising:

a compression member, operative to apply a compression to a front of at least one of a ribcage region or an abdomen region of a subject to cause exhalation during an exhalation portion of a respiration cycle of the subject;

a lifting member, operative to pull on a body part of the subject toward a superior direction toward a skull of the subject, wherein the body part being pulled in the superior direction includes at least one of a xiphoid region, a sternum region, an abdominal region, an interchondral region, a costal cartilage region, a thorax region, a shoulder region, a upper limb region, a lower limb region, a neck region, or a skull region of the subject during an inhalation portion of a respiration cycle of the subject; and a cyclical member, configured to actuate the compression member to apply the compression during the exhalation portion of the respiration cycle of the subject, and configured to actuate the lifting member to pull on the body part of the subject toward the superior direction during the inhalation portion of the respiration cycle.

2. The respiration assistance apparatus of claim 1, wherein the lifting member includes a shoulder harness operative to pull a shoulder or clavicle of the subject in the superior direction toward the subject's skull during the inhalation portion of the respiration cycle of the subject.

3. The respiration assistance apparatus of claim 1, wherein the lifting member includes a shoulder harness operative to pull on the body part toward a superior direction toward the subject's skull.

4. The respiration assistance apparatus of claim 1, wherein the lifting member includes a chest harness operative to pull on the body part toward the superior direction toward the subject's skull.

5. The respiration assistance apparatus of claim 1, wherein the lifting member includes a mastoid process harness operative to pull on the body part toward the superior direction toward the subject's skull.

6. The respiration assistance apparatus of claim 1, wherein the cyclical member includes a continuously rotating cyclical multi-action cam, the cam rotatable to provide a variable radius periphery first action during cam rotation and a variable height path second action during the cam rotation, one of the first and second actions actuating pulling the body part toward the superior direction toward the subject's skull during the inhalation portion of the respiration cycle and the other of the first and second actions actuating the compression member during the exhalation portion of the respiration cycle.

7. The respiration assistance apparatus of claim 6, wherein coordination between pulling the body part toward the superior direction toward the subject's skull during the inhalation portion of the respiration cycle and compression during the exhalation portion of the respiration cycle is coordinated by an arrangement of the first action of the multi-action cam with respect to the second action of the multi-action cam.

8. The respiration assistance apparatus of claim 1, comprising a fixed reference, configured to provide the fixed reference with respect to the subject, and with respect to the fixed reference the pulling the body part toward the superior direction toward the subject's skull during the inhalation portion of the respiration cycle and the compression during the exhalation portion of the respiration cycle is carried out.

9. The respiration assistance apparatus of claim 8, wherein the fixed reference includes wearable garment.

10. A respiration assistance method of using a cyclic device, the method comprising:

using a compression member, applying a compression to a front of at least one of a ribcage region or an abdomen region of a subject to cause exhalation during an exhalation portion of a respiration cycle of the subject;

using a lifting member, pulling on a body part of the subject toward a superior direction toward a skull of the subject, wherein the body part being pulled in the superior direction includes at least one of a xiphoid region, a sternum region, an abdominal region, an interchondral region, a costal cartilage region, a thorax region, a shoulder region, a upper limb region, a lower limb region, a neck region, or a skull region of the subject during an inhalation portion of the respiration cycle of the subject; and using a cyclical member, actuating the compression member to apply the compression during the exhalation portion of the respiration cycle of the subject, and actuating the lifting member to pull on the body part of the subject toward the superior direction during the inhalation portion of the respiration cycle.

11. The respiration assistance method of claim 10, wherein using the lifting member includes using a shoulder harness operative to pull a shoulder or clavicle in the superior direction toward the subject's skull during the inhalation portion of the respiration cycle of the subject.

12. The respiration assistance method of claim 10, wherein using the lifting member includes using a shoulder harness operative to pull on the body part toward a superior direction toward the subject's skull.

13. The respiration assistance method of claim 10, wherein using the lifting member includes using a chest harness operative to pull on the body part toward a superior direction toward the subject's skull.

14. The respiration assistance method of claim 10, wherein using the lifting member includes using a mastoid process harness operative to pull on the body part toward a superior direction toward the subject's skull.

15. The respiration assistance method of claim 10, wherein using the cyclical member includes using a continuously rotating cyclical multi-action cam, the cam rotatable to provide a variable radius periphery first action during cam rotation and a variable height path second action during the cam rotation, one of the first and second actions actuating pulling the body part toward a superior direction toward the subject's skull during the inhalation portion of the respiration cycle and the other of the first and second actions actuating the compression member during the exhalation portion of the respiration cycle.

16. The respiration assistance method of claim 15, wherein coordination between pulling the body part toward the superior direction toward the subject's skull during the inhalation portion of the respiration cycle and compression during the exhalation portion of the respiration cycle is coordinated by an arrangement of the first action of the multi-action cam with respect to the second action of the multi-action cam.

17. The respiration assistance method of claim 10, comprising using a reference, configured to provide a fixed reference with respect to the subject, and with respect to the reference is performed the pulling the body part toward the superior direction toward the subject's skull during the inhalation portion of the respiration cycle and the compression during the exhalation portion of the respiration cycle is carried out.

18. The respiration assistance method of claim 17, wherein using the reference includes using a wearable garment.

19. A respiration assistance apparatus comprising:

means for applying a compression to a front of at least one of a ribcage region or an abdomen region of a subject to cause exhalation during an exhalation portion of a respiration cycle of the subject;

means for pulling on a body part of the subject toward a superior direction toward a skull of the subject, wherein the body part being pulled in the superior direction includes at least one of a xiphoid region, a sternum region, an abdominal region, an interchondral region, a costal cartilage region, a thorax region, a shoulder region, a upper limb region, a lower limb region, a neck region, or a skull region of the subject during an inhalation portion of the respiration cycle of the subject; and means for actuating the means for applying the compression during the exhalation portion of the respiration cycle of the subject, and actuating the means for pulling on the body part of the subject toward the superior direction during the inhalation portion of the respiration cycle.

20. The respiration assistance apparatus of claim 19, wherein means for pulling includes a shoulder harness operative to pull a shoulder or clavicle in the superior direction toward the subject's skull during the inhalation portion of the respiration cycle of the subject.

* * * * *